US005951783A

United States Patent [19]

Kontorovich et al.

[11] Patent Number: 5,951,783

[45] Date of Patent: Sep. 14, 1999

[54] UNIVERSAL WASHING APPARATUS FOR MICROTITER PLATE AND THE LIKE

[75] Inventors: Michael Kontorovich, Colchester; Jonathan S. Trefry, Hinesburg; Daniel J. Venditti, Jr., Colchester, all of Vt.

[73] Assignee: Bio-Tek Holdings, Inc., Winoski, Vt.

[21] Appl. No.: 09/079,185

[22] Filed: May 15, 1998

[51] Int. Cl.[6] ..... B08B 3/02

[52] U.S. Cl. ..... 134/21; 15/302; 134/22.18; 134/24; 134/168 R; 134/171

[58] Field of Search ..... 15/302, 304; 134/21, 134/22.18, 24, 167 R, 168 R, 171

[56] References Cited

U.S. PATENT DOCUMENTS 3,849,830 11/1974 Wagner .
4,015,942 4/1977 Coupe .
4,341,568 7/1982 Christensen ..... 15/304 X
4,559,664 12/1985 Böhme et al. .
4,635,665 1/1987 Namba et al. .
4,685,480 8/1987 Eck .
5,078,164 1/1992 Doellgast .
5,105,842 4/1992 Wells .
5,113,886 5/1992 Wells et al. ..... 134/167 R X
5,186,760 2/1993 Rubenzer .
5,264,042 11/1993 Wells et al. .
5,325,609 7/1994 Wells ..... 134/167 R
5,636,647 6/1997 Keene et al. .

*Primary Examiner*—Philip R. Coe
*Attorney, Agent, or Firm*—Sughrue, Mion, Zinn, Macpeak & Seas, PLLC

[57] ABSTRACT

A universal washing apparatus for use in washing wells provided in reaction containers such as wells of microtiter plates and the like. The washing apparatus has separate dispense and aspirate manifolds positioned one on top of the other which may be independently lowered or raised with respect to a microtiter plate for performing various wash operations. The washing apparatus uses an indexing mechanism for indexing the well plate relative to the manifolds in the horizontal plane so that the washing apparatus is compatible for washing different well plate configurations.

30 Claims, 23 Drawing Sheets

UNIVERSAL WASHING APPARATUS FOR MICROTITER PLATE AND THE LIKE

BACKGROUND OF THE INVENTION

1. Field of the Invention

This invention relates to a universal washing apparatus, and in particular a washing apparatus for use in washing wells provided in reaction containers such as wells of microtiter plates, microcups and the like containers designed to hold samples or reagents used for chemical, immunological and other reactions.

2. Description of Related Art

Certain laboratory operations require the testing of small samples such as immuno assays which are carried out in an arrangement of microwells or wells having volumes of, for example, 50–300 microliters or less formed in microtiter plates, hereinafter referred to generically as well plates. An example of this type of laboratory operation is an enzyme linked immunosorbent assay or "ELISA" reaction which is performed for measuring antigens and/or antibodies.

Reactions of this type involve the adding and removing of liquid reagents within each well. At several stages of the reactions, the unbound liquid remaining in the wells must be removed and the inside of the wells must be washed by dispensing a wash solution such as water, a buffer solution, or other fluid in the wells using a gravity feed or a pump, and then evacuating the liquid under a vacuum.

The wells can be arranged in a strip or in-line format, or can be arranged in a matrix format. Until recently, commonly used matrices were configured to have 8×12 wells spaced at 9 mm apart between centers, hereinafter referred to as a 96-well plate. FIG. 1 illustrates a 96-well plate 1 having wells 2. However, with the advent of high throughput screening ("HTS"), two more matrixes were introduced which increased the total number of wells while keeping the overall size of the well plate the same: 1) the 384-well plate 3, as shown in FIG. 2, configured to have 16×24 wells 4 spaced at 4.5 mm apart between centers, and 2) the 1536-well plate configured to have 32×48 wells spaced at 2.25 mm apart between centers (not shown). Since the overall size of these new well plates are the same as the 96-well plate 1, the size of the wells in the new well plates is necessarily smaller than those in the 96-well plates while the depth of the wells remains the same.

A conventional washer used for removing the unbound contents in wells of a well plate includes dispense pipes for dispensing the wash solution into the wells of the well plate (e.g., by a pump or gravity feed), and aspirate pipes for evacuating the solution from the wells of the well plate (e.g., by a vacuum or a suction device). In order to quickly wash the well plates, the washing process is performed simultaneously on as many wells of the well plate as possible. A commercial example of such a washer is the SLT-LABINTRUMENTS 96PW washer.

Washers for cleaning the 96-well plate are well known. The conventional multi-well washing apparatuses of this type are constructed so that the dispense and aspirate pipes are connected to the same manifold body. When performing a wash operation, the wash solution enters the dispense portion of the manifold and gets channeled to the dispense pipes. Accordingly, the purpose of the dispense portion of the manifold is to distribute uniformly the incoming wash solution among the respective dispense pipes. The contents of the wells are then evacuated by the respective aspirate pipes into the aspirate portion of the manifold. Accordingly, the purpose of the aspirate portion of the manifold is to channel the wash solution from all the aspirate pipes into a common waste line.

Conventional washing apparatuses generally fall into one of two configurations which define the arrangement of the dispense and aspirate pipes:

1. the pipe-within-a-pipe configuration, as disclosed in (U.S. Pat. No. 4,635,665) and further illustrated in FIG. 3, wherein the dispense pipe 7 is disposed inside the aspirate pipe 6 such that the tips of both pipes at their respective open ends are disposed approximately in the same horizontal plane; and
2. the pipe-next-to-pipe configuration as shown in FIG. 5 wherein the dispense pipe 11 is disposed adjacent to the aspirate pipe 10 so that both pipes fit within a single well 2, and wherein the dispense pipe 11 is slightly shorter than aspirate pipe 10 by a distance δ (e.g., by 1–3 mm).

U.S. Pat. Nos. 3,849,830; 4,015,942; 4,559,664; 4,685,480; 5,078,164; 5,105,842; 5,186,760; 5,264,042; and 5,636,647 are additional examples of washing apparatuses and are incorporated herein by reference.

The foregoing two conventional washing apparatus configurations were created for use with the 96-well plate having 6 mm diameter wells. The pipe-within-a-pipe configuration has an outer pipe diameter of approximately 3.5 mm, and the pipe-next-to-pipe configuration has approximately 2.5 mm between pipe centers with each pipe being approximately 1 mm in diameter. Thus the overall dimension of the pair of pipes which enter a well during an evacuation process is less than the well diameter of a 96-well plate. However, the diameter of the wells in the new 384-well plate measures about 2.5 mm at the bottom of the well, and the diameter of the wells in the 1536-well plate is even smaller. Therefore, due to the smaller size wells, none of the conventional washing apparatus configurations described above can be used to evacuate the smaller wells of the 384- and 1536-well plates.

Next, different types of wash operations will be described with reference to the two conventional washing apparatus configurations described above.

An overflow wash operation occurs when the volume of wash solution dispensed into each well exceeds the capacity of the well and the excess wash solution is evacuated from the well by the aspirating pipe. Overflow washing is important when vigorous washing of the wells is required for successful removal of unbound material in the course of some reactions.

The two conventional washing apparatus configurations do allow for overflow washing of the standard large wells of the 96-well plates. However, as shown in FIG. 4, in the pipe-within-a-pipe configuration the overflow wash capability is limited due to the possibility of the suctioning off of the wash solution directly from the dispense pipe before the wash solution enters the well. This is particularly a problem when the dispense pipe dispenses the wash solution at low fluid delivery rates.

In the case of the pipe-next-to-pipe configuration as shown in FIG. 5, the overflow washing capability of large 96-well plates is improved due to the greater distance between the tips of dispense pipe 11 and aspirate pipe 10 which reduces the possibility of suctioning off the wash solution 8 before it is dispensed within the well 2.

On the other hand, the pipe-within-a-pipe configuration, is capable of performing what is known in the industry as a "bottom sweep" evacuation wash operation wherein the aspirate pipe 6 is positioned sequentially in several areas of the large 96-well plate wells close to the side walls for efficient evacuation.

However, as shown in FIG. 6, the ability of the pipe-next-to-pipe configuration to perform an efficient evacuation or bottom sweep of the well is restricted because the dispense pipe 11 limits how close the aspirate pipe 10 can be positioned to the inner wall of the well 2.

Attempts have been made to resolve the bottom sweep evacuation limitation of the pipe-next-to-pipe configuration. For example, as shown in FIG. 7, the dispense pipe 15 was made shorter than the aspiration pipe 14 by a distance slightly larger than the depth of the well 2. However, as shown in FIG. 8, this resulted in considerable splashing of the liquid being dispensed from the increased height position relative to the well 2, and the possible contamination of adjacent wells.

Thus, the foregoing conventional washers have limitations in washing conventional 96-well plates.

Furthermore, the recent introduction of the new well plates defined by larger matrices (i.e., the 384- and 1536-well plates) having narrower wells positioned closer to each other brought to light another limitation of the foregoing conventional washers. Namely, as noted above, the pipe-within-a-pipe and pipe-next-to-pipe configurations are adapted for washing relatively large diameter wells which are not available in the more recent well plates with the larger matrices. While the shortened dispense pipe 15 shown in FIG. 7 would permit the use of a conventional washer to aspirate the smaller size wells of the new well plates, the resulting splashing of liquid makes its use impractical since the contents of one well may splash into adjacent wells and contaminate them. Therefore, the conventional washers cannot be used with the newer well plates.

As shown in FIG. 9, one proposed solution that came to market for washing well plates having the new smaller well geometries is to provide a separate dispense manifold 19 having dispense pipes 20 and an aspirate manifold 17 having aspirate pipes 18 positioned in two separate locations next to each other. According to this design, the well plate 3 is first presented to the dispense manifold 19 for dispensing the wash solution, and, next, moved to the aspirate manifold 17 for the evacuation of the unbound contents in the wells 4. One commercial example of such a washer is the SCATRON EMBLA 384 model. While the small aspirate pipes 18 of this split manifold design are able to fit into the smaller new wells 4, the design can not be used to perform overflow washing of wells. Furthermore, the additional time required to move the well plate (or manifolds) between the dispense position and aspirate position is long, thereby reducing the efficiency of the washing operation. Moreover, the overall dimensions of an apparatus having this design is necessarily large.

Accordingly, the foregoing conventional apparatuses have one or more shortcomings in that they are not able to provide simultaneously within the same apparatus:

1. the ability to wash wells using an overflow wash operation for vigorously washing the wells,
2. the ability to place an evacuation pipe in any or multiple places within each well to effectively evacuate the contents of the wells, and
3. the ability to wash wells having a relatively small diameter such that only a single small aspirate pipe can be placed within the well such as those found in the newer well plates.

SUMMARY OF THE INVENTION

It is, therefore, an object of the invention to provide a washing apparatus which is capable of eliminating the aforementioned drawbacks of known art washers.

Another object of the invention is to provide a washing apparatus that has the ability to wash wells with overflow for performing a vigorous wash operation.

Yet another object of the invention is to provide a washing apparatus that has the ability to place the aspiration pipes in any or multiple locations within the wells to effectively evacuate the contents of the wells.

A further object of the invention is to provide a washing apparatus that has the ability to wash wells having diameters large enough for only a single small diameter aspirate pipe to be placed in the wells such as in the case of a 384-well plate and a 1536-well plate.

Another object of the invention is to provide a washing apparatus that has the ability to effectively wash standard 96-well plates as well as the 384- and 1536-well plates.

Still another object of the invention is to provide a washing apparatus having dispense and aspirate pipes arranged over a well plate and which can be independently raised or lowered relative to the well plate.

Yet another object of the invention is to provide a washing apparatus having a separate dispense manifold with dispense pipes and a separate aspirate manifold with aspirate pipes, wherein the aspirate pipes pass through openings in the dispense manifold when lowered towards the well plate.

Yet another object of the invention is to provide a washing apparatus having a separate dispense manifold with dispense pipes and a separate aspirate manifold with aspirate pipes, wherein the dispense pipes pass through openings in the aspirate manifold when lowered towards the well plate.

Another object of the invention is to provide a washing apparatus wherein the dispense pipes can be disposed at an angle relative to the aspirate pipes.

Still another object of the invention is to provide a washer having an indexing mechanism for indexing the dispense pipes and aspirate pipes relative to a well plate.

A still further object of the invention is to provide a washing apparatus which includes a priming trough into which the dispense pipes and aspirate pipes may be lowered.

These and other objects are realized by the invention which provides a washing apparatus including:

a well plate support for supporting a well plate during a wash operation, a plurality of dispense pipes for dispensing a wash solution into the wells, a dispense pipe support structure for supporting said dispense pipes, a plurality of aspirate pipes for evacuating the wash solution from the wells, an aspirate pipe support structure for supporting said aspirate pipes, and a guide mechanism for changing relative horizontal and vertical distances between said dispense pipes and said aspirate pipes and between said dispense pipes and said well plate support; said mechanism for changing relative horizontal and vertical distances further being operable, during the wash operation, for simultaneously positioning said dispense pipe support structure and said aspirate pipe support structure over the well plate support so that one of said dispense pipe support structure and said aspirate pipe support structure, defining a top pipe support structure, is positioned on top of the other of said dispense pipe support structure and said aspirate pipe support structure, defining a bottom pipe support structure.

BRIEF DESCRIPTION OF THE DRAWINGS

The above and other objects of the present invention can be better understood with reference to the following detailed description of the specific embodiments when considered in combination with the drawings that form part of the specification, wherein.

DESCRIPTION OF THE PREFERRED EMBODIMENT

Figure 1:
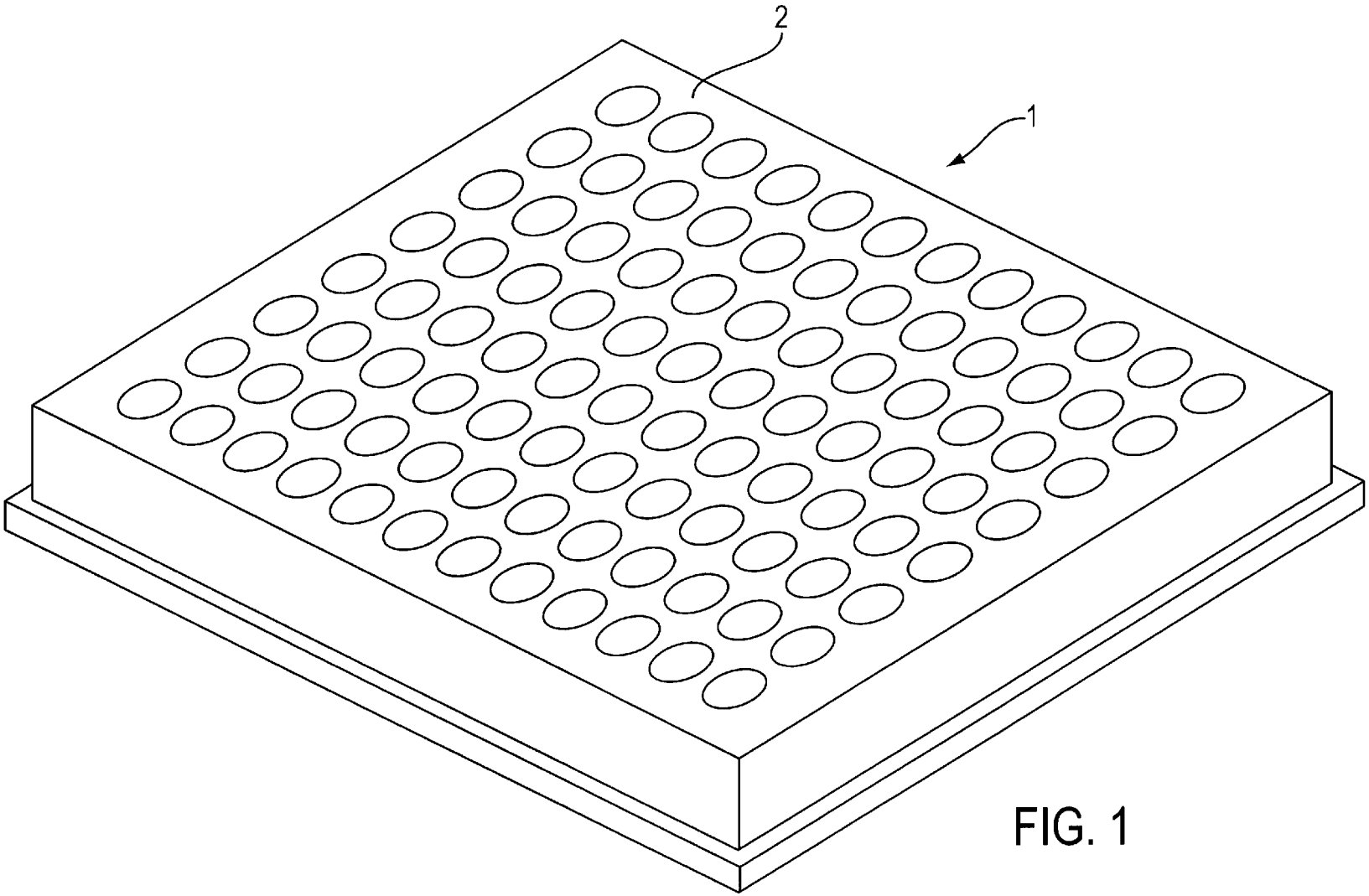
FIG. 1 is a perspective view of a known 96-well plate.
Figure 2:
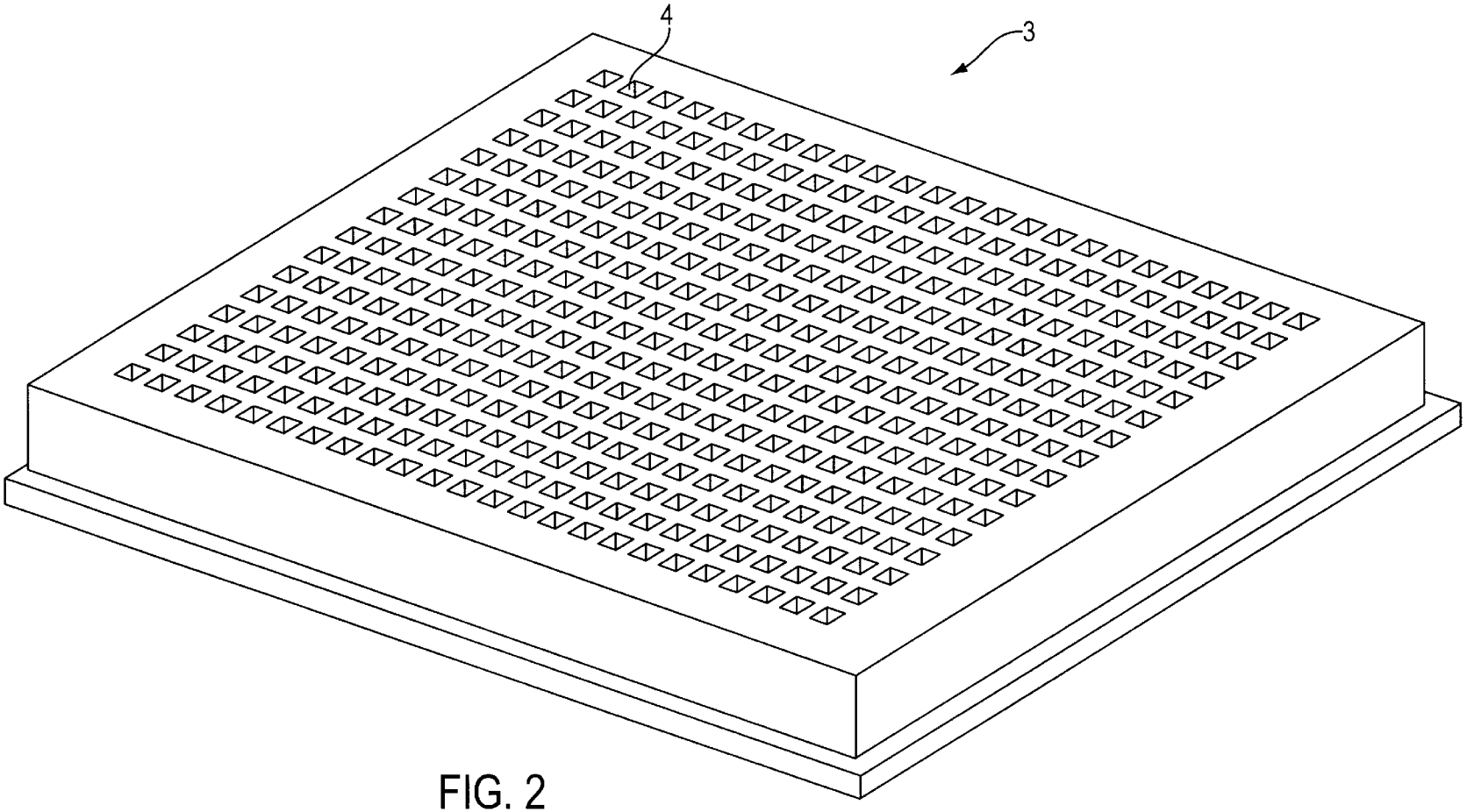
FIG. 2 is a perspective view of a known 384-well plate.
Figure 3:
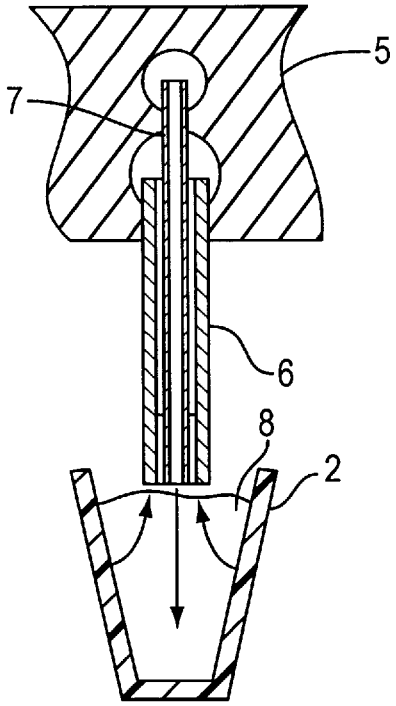
FIG. 3 (PRIOR ART)
FIG. 3 is a cross-sectional view of dispense and aspirate pipes illustrating an overflow wash operation using the conventional pipe-within-a-pipe configuration.
Figure 4:
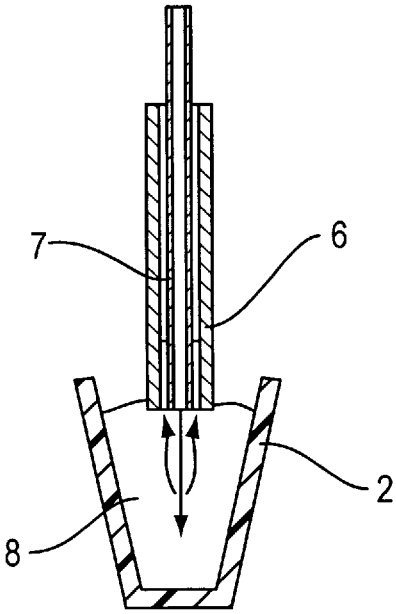
FIG. 4 (PRIOR ART)
FIG. 4 is a cross-sectional view of dispense and aspirate pipes illustrating a problem related to the operation of the conventional pipe-within-a-pipe configuration.
Figure 5:
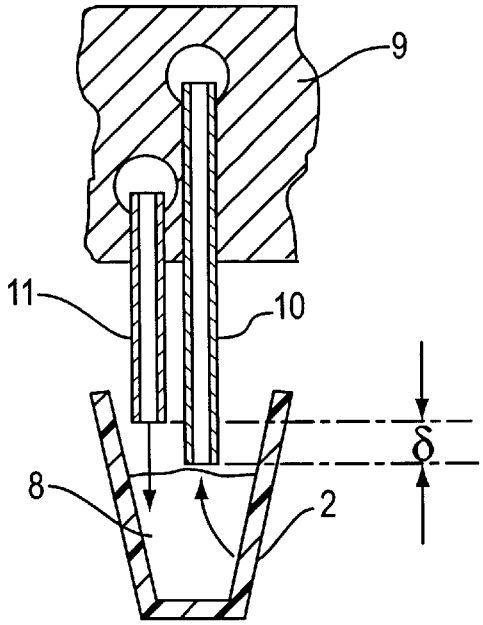
FIG.5 (PRIOR ART)
FIG. 5 is a cross-sectional view of dispense and aspirate pipes illustrating an overflow wash operation using the conventional pipe-next-to-pipe manifold configuration.
Figure 6:
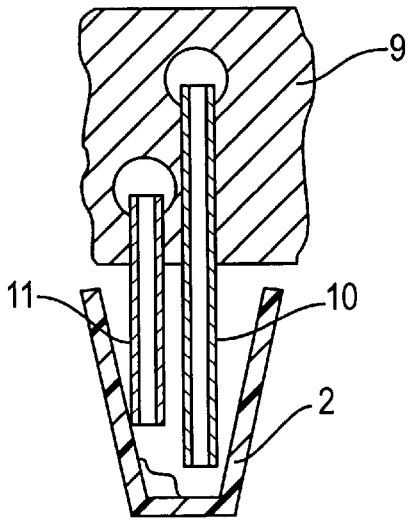
FIG.6 (PRIOR ART)
FIG. 6 is a cross-sectional view of dispense and aspirate pipes illustrating a problem related to the operation of the conventional pipe-next-to-pipe configuration.
Figure 7:
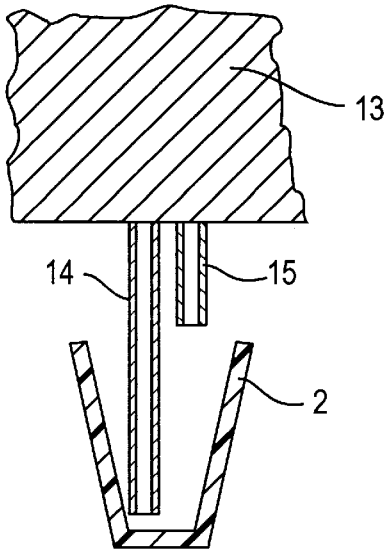
FIG. 7 (PRIOR ART)
FIG. 7 is a cross-sectional view of dispense and aspirate pipes illustrating a "bottom sweep" operation in the case of a conventional washing apparatus having a shortened dispense pipe.
Figure 8:
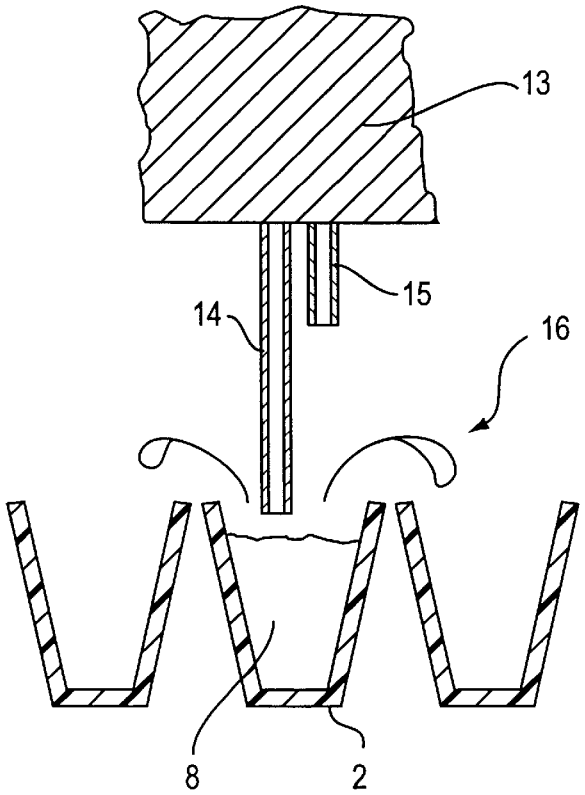
FIG. 8 (PRIOR ART)
FIG. 8 is a cross-sectional view of dispense and aspirate pipes illustrating a problem related to the wash operation using a conventional washing apparatus having a shortened dispense pipe.
Figure 9:
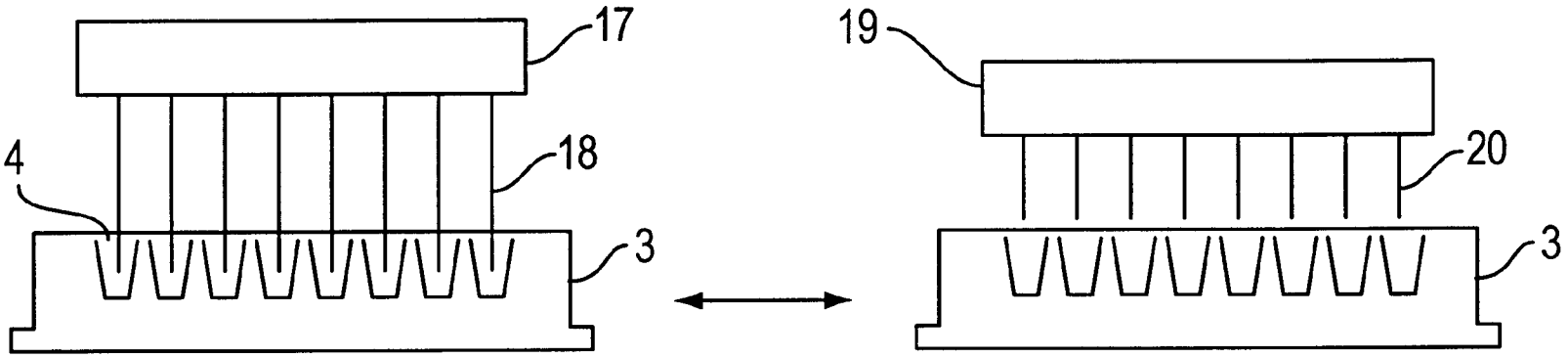
FIG. 9 (PRIOR ART)
FIG. 9 is a cross-sectional view of a conventional two manifold arrangement for washing small diameter wells.
Figure 10A:
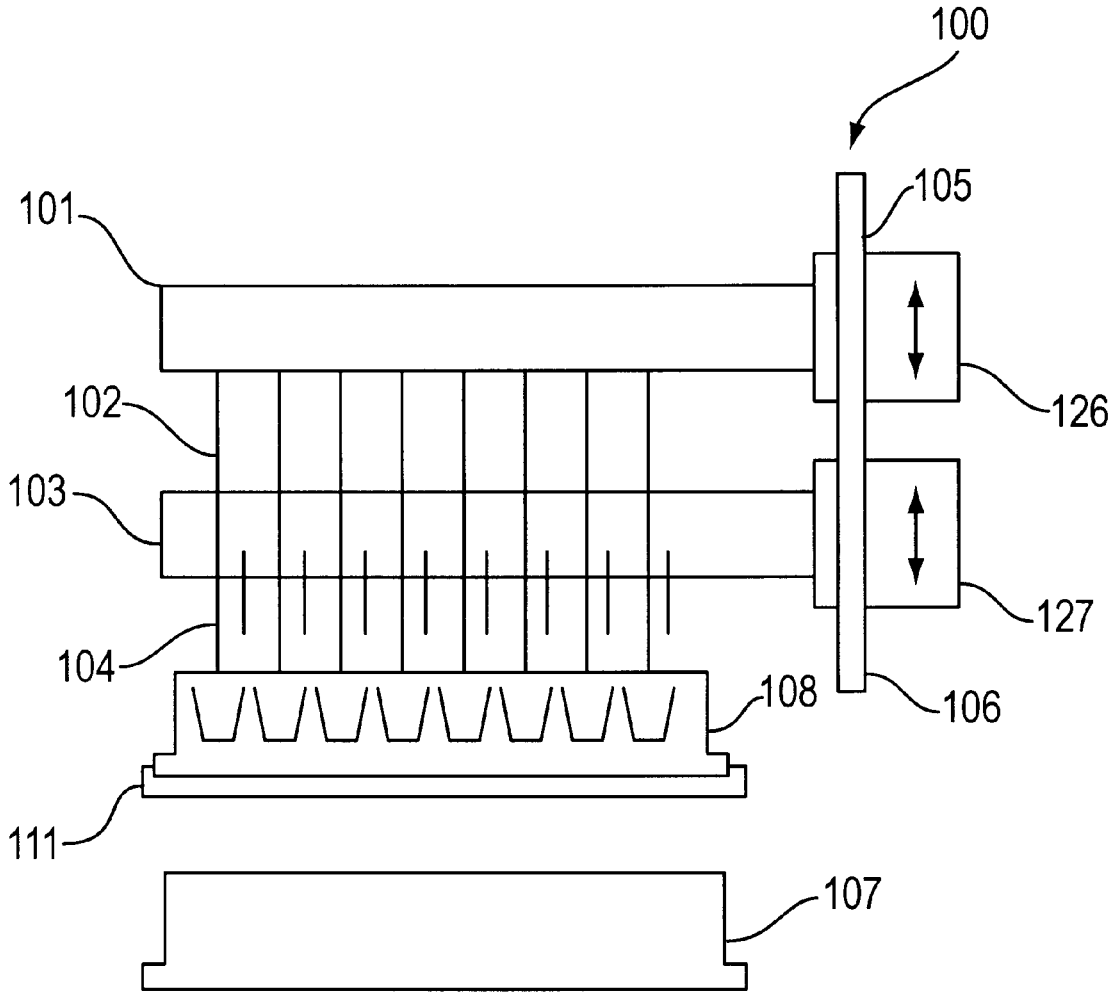
FIGS. 10A–10H are side and perspective views of a proposed split manifold arrangement showing various structures for supporting and moving the manifolds and support plate.

FIG. 10A shows a washing apparatus 100 including a top manifold 101 (e.g., an aspirate manifold), having a set of pipes 102 connected thereto, and a bottom or lower manifold 103 (e.g., a dispense manifold), having a set of pipes 104 connected thereto. As shown in FIG. 10A, the top and bottom manifolds are two physically different parts arranged on top of each other. The bottom manifold 103 is constructed in such a manner as to allow the pipes 102 from the top manifold to pass through the bottom manifold and enter the respective wells of the well plate 108 supported below both manifolds. One way to accomplish this is to drill holes or passages 110 (see FIG. 11) in the bottom manifold 103 next to each pipe in the bottom manifold corresponding to the arrangement of pipes in the top manifold 102. Accordingly, the pipes in the top manifold 102 can pass through the holes 110 in order to reach the wells of the well plate 108. Alternatively, the bottom manifold 103 can have openings or slots that permit the pipes from the top manifold to reach into the wells.

Figure 10B:
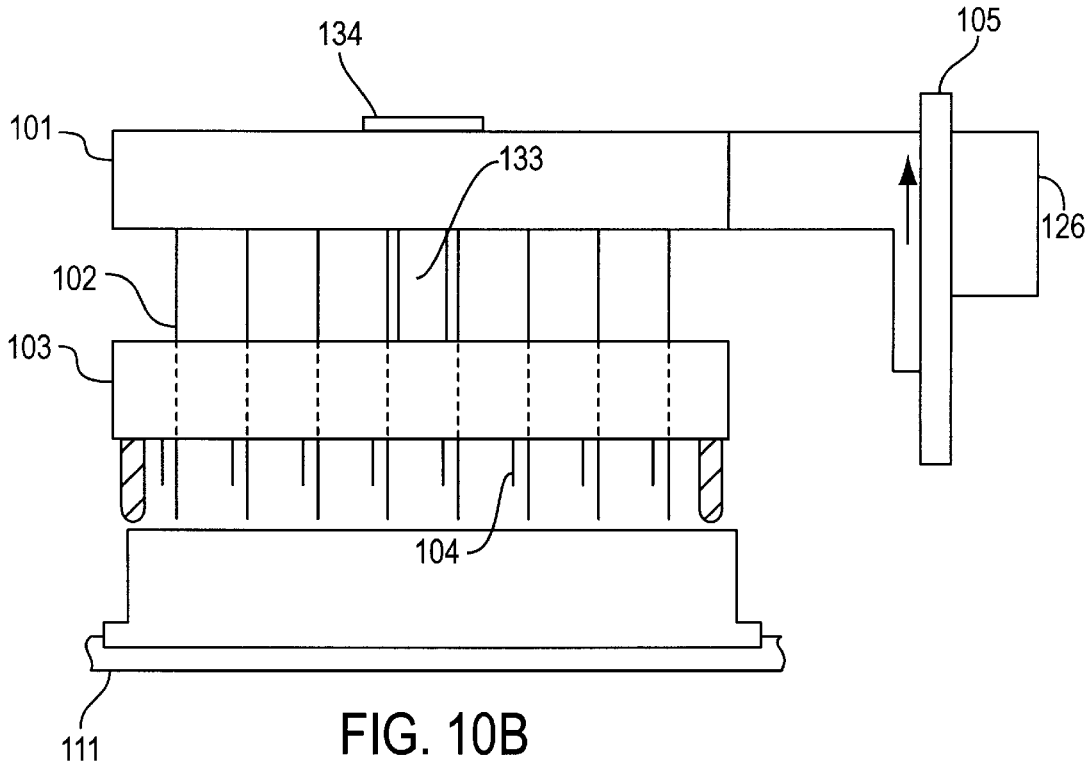
Figure 10C:
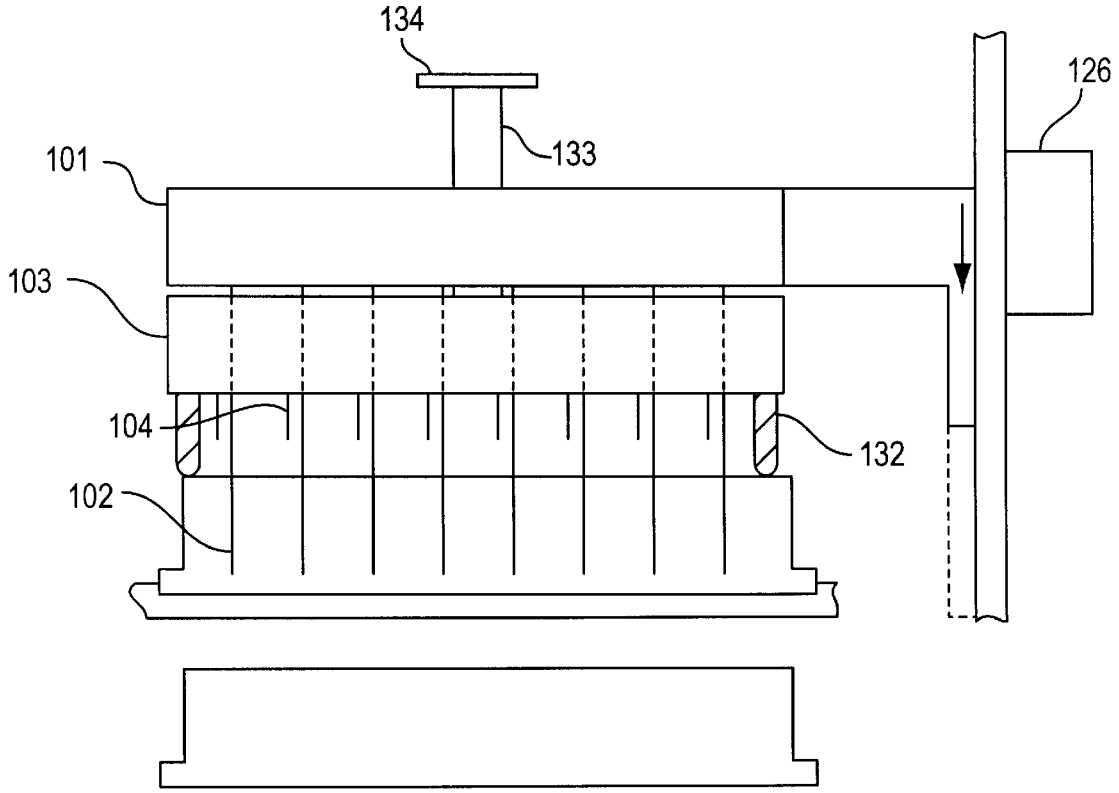
Figure 10D:
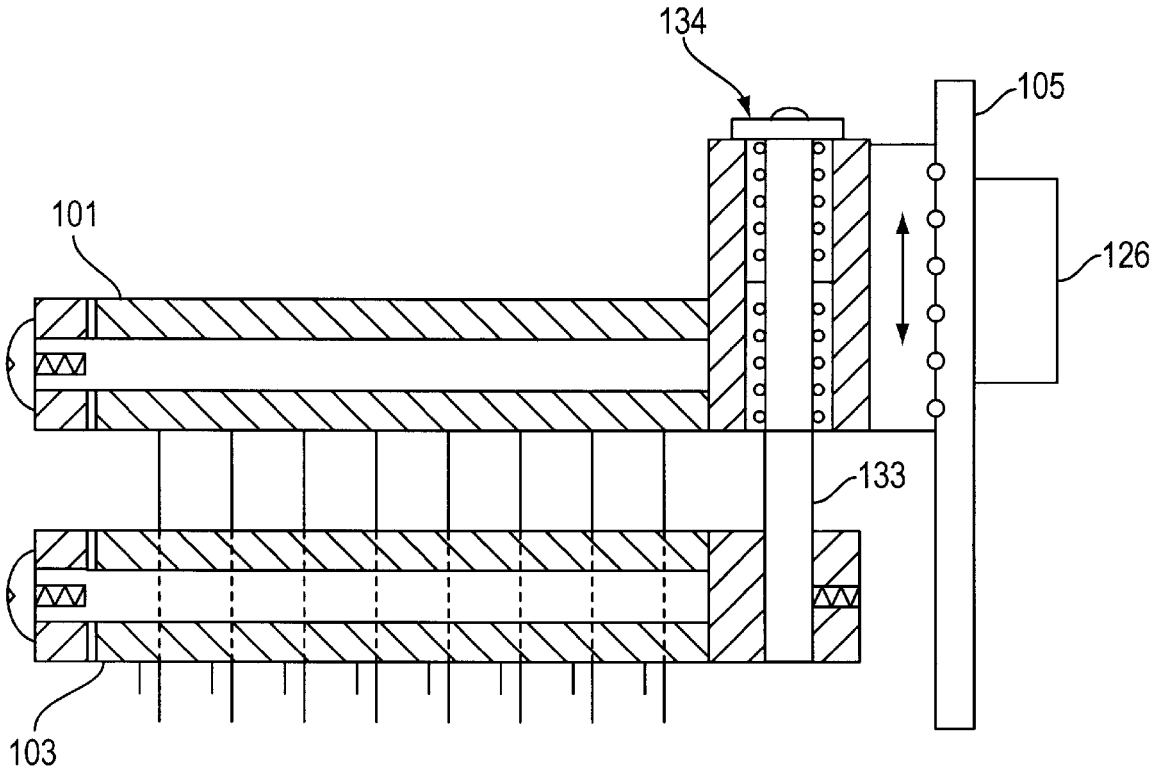
Figure 10E:
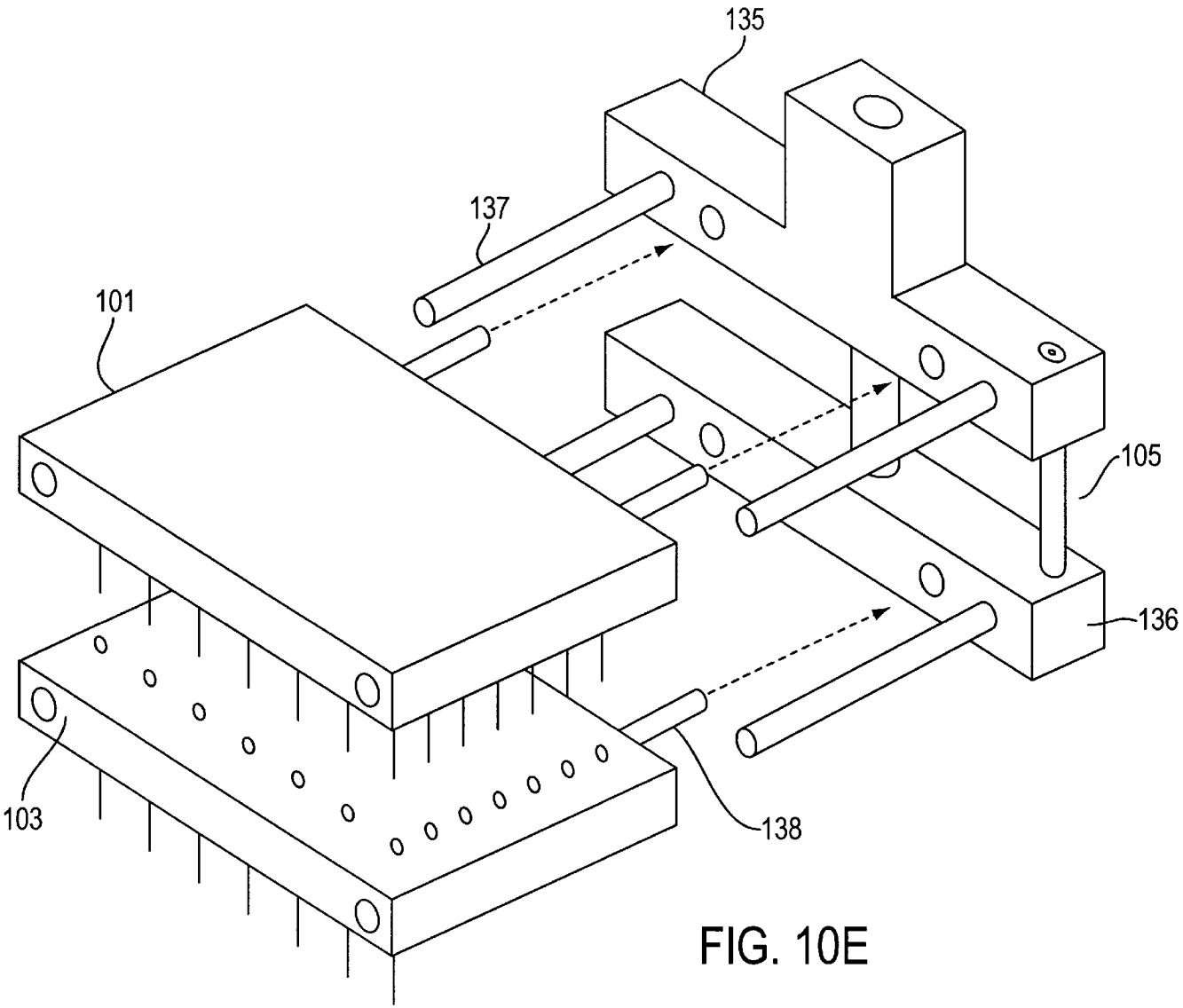

The top manifold 101 is supported by a vertical linear guide 105 which is driven by a first drive unit 126 for guiding the top manifold along the path of the linear guide 105. Similarly, the bottom manifold 103 is supported by a vertical linear guide 106 which is driven by a second drive unit 127 for guiding the bottom manifold along the path of the linear guide 106. Accordingly, the top and bottom manifolds can be lowered or raised independently of one another. FIGS. 10B–10E provide examples of a variety of other structures which may be employed to support the manifolds and permit their independent movement. As shown in FIGS. 10B–10D, the bottom manifold moves along a guide 133 fixed to the top manifold. In this case, a stop 134 limits the downward movement of the bottom manifold. FIG. 10E illustrates a support structure having an upper support bracket 135 for supporting the top manifold 101 and a lower support bracket 136 for supporting the bottom manifold 103, and which uses rods 137 for coupling the manifolds to the support structures as well as tubing 138 for providing liquid conduits to and from the manifolds.

Figure 10F:
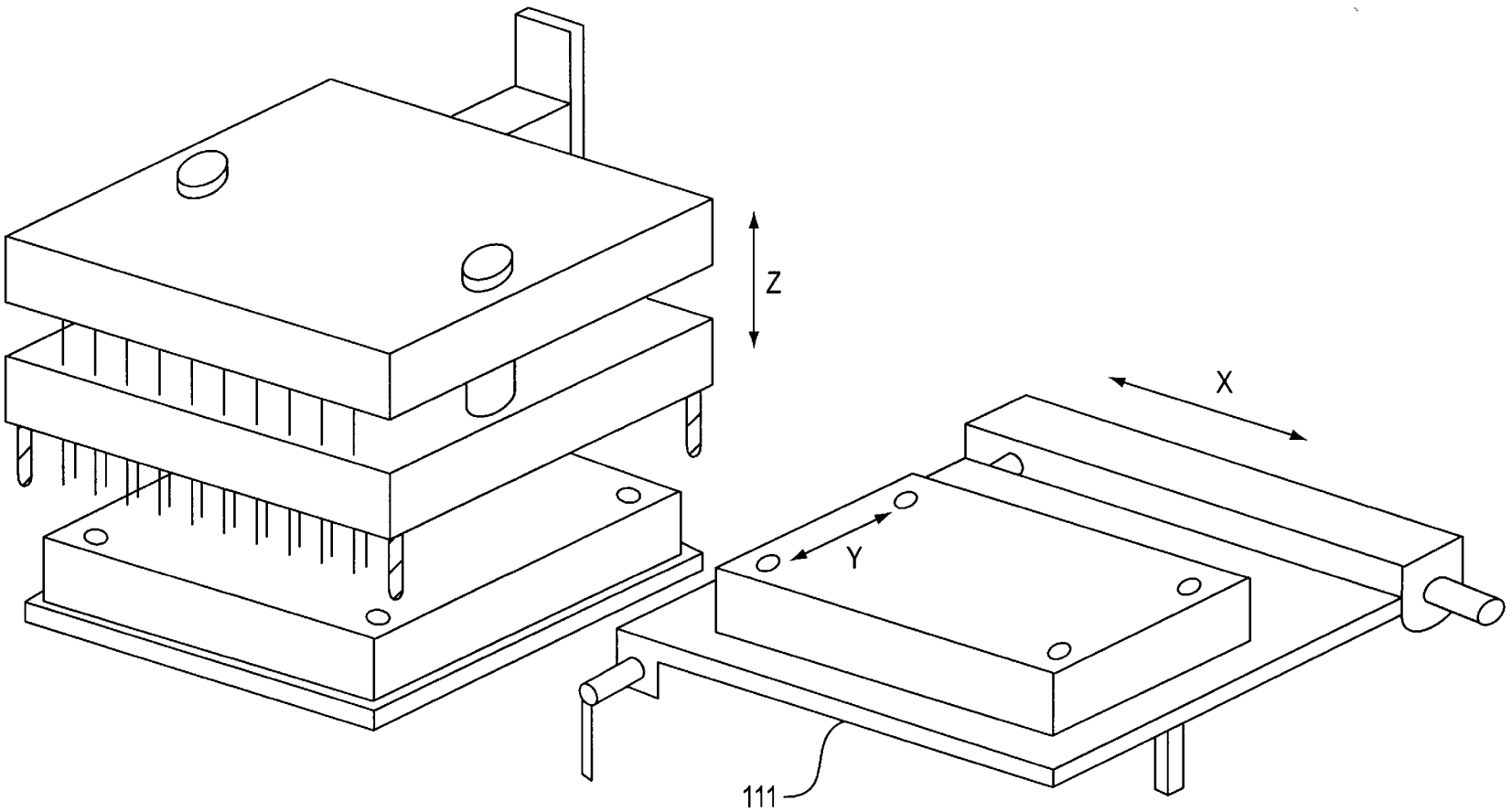
Figure 10G:
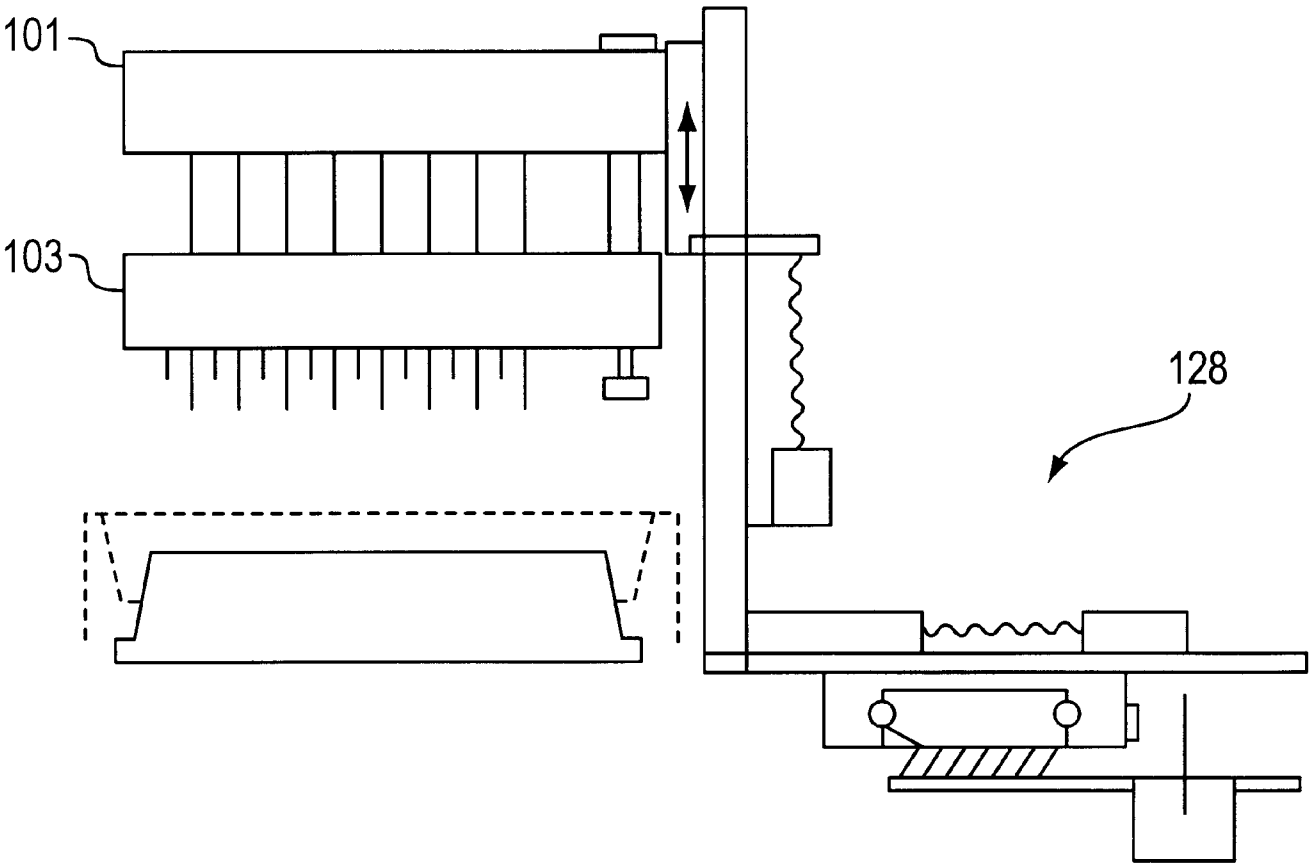
Figure 10H:
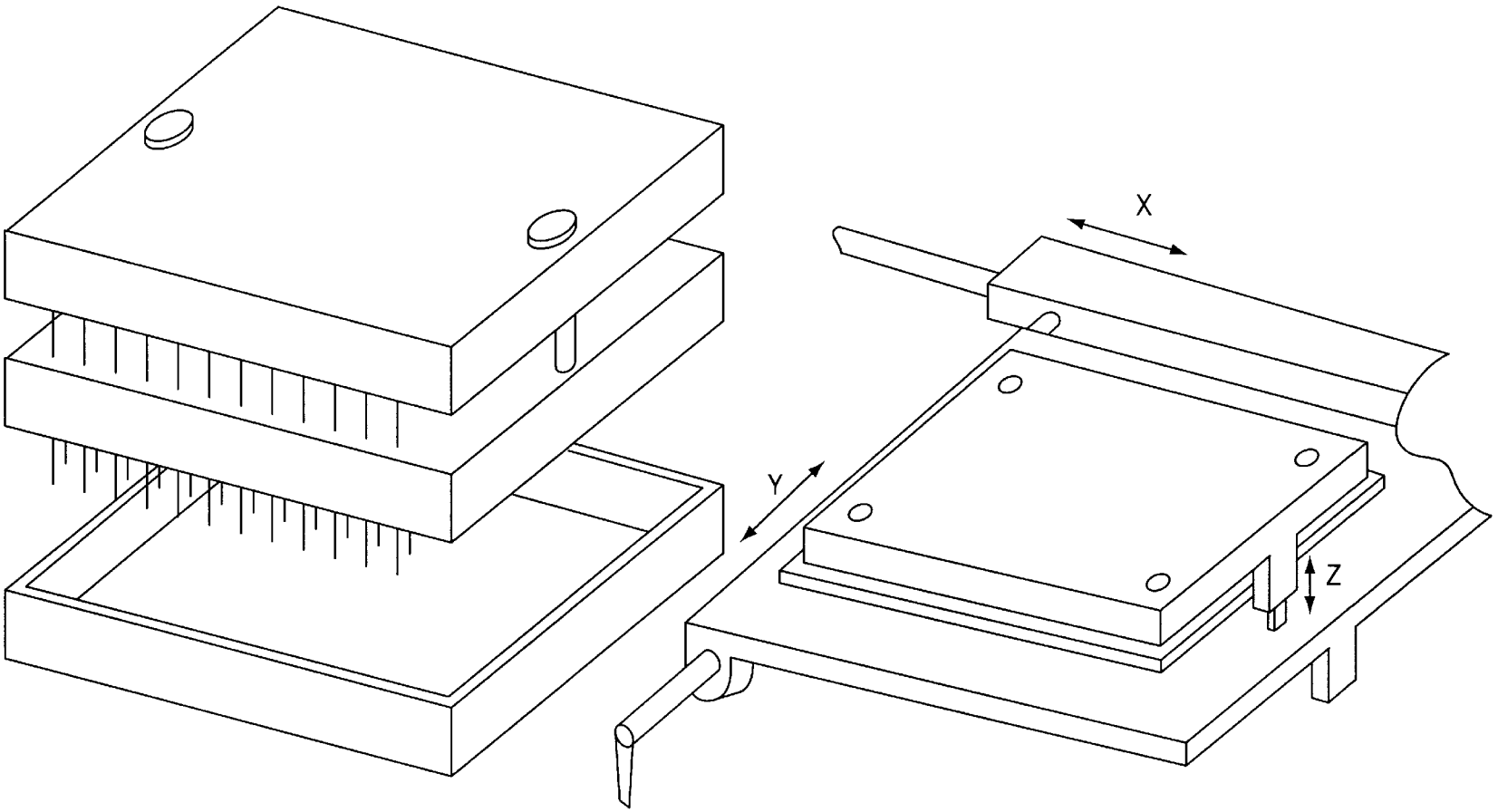

The well plate support mechanism or carrier 111, as shown in FIG. 10F supports the well plate 108, and is capable of indexing the well plate in the horizontal plane for performing wash operations with various well plate designs as will be explained below. Alternatively, as shown in FIG. 10G, the dispense and aspirate manifolds can include respective guides and driving mechanisms 128 for indexing the manifolds in the horizontal plane. It is understood, however, that an important feature of the invention is to have relative movement between the top manifold, bottom manifold, and carrier in both the vertical and horizontal directions; and that a variety of combinations defining which components to move and which components to leave stationary can be employed to achieve the desired relative movement. For example, FIG. 10H illustrates the case in which the carrier support is operable to be moved in both the horizontal and vertical directions. Accordingly, only one of the top and bottom manifolds will need to be movable in the vertical direction to achieve the required relative movement.

Finally, as shown in FIGS. 10C and 10F a priming trough or plate 107 is provided below the well plate support, and contains a solution into which the dispense and aspirate pipes can be lowered for priming the pipes and preventing build-up of salt crystallization as explained below.

Figure 11:
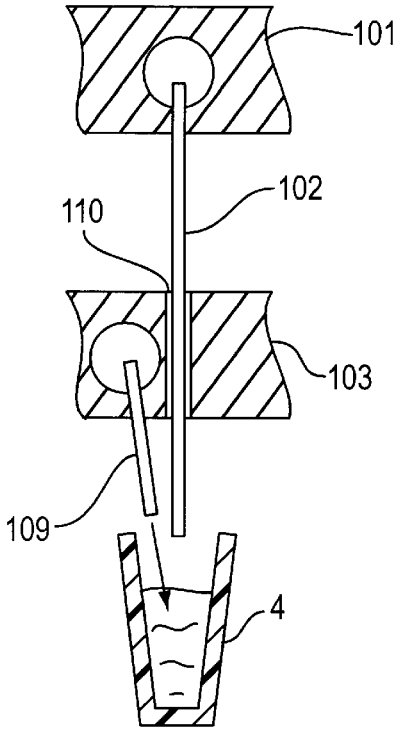
FIG. 11 is a cross-sectional view of dispense and aspirate pipes illustrating a dispense with overflow wash operation using a tilted dispense pipe in accordance with an embodiment of the invention.
Figure 12A:
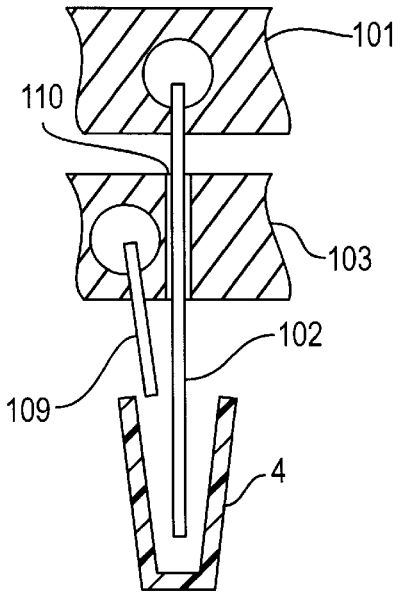
FIG. 12A is a cross-sectional view of dispense and aspirate pipes illustrating an evacuation with overflow wash operation using a tilted dispense pipe in accordance with an embodiment of the invention.
Figure 12B:
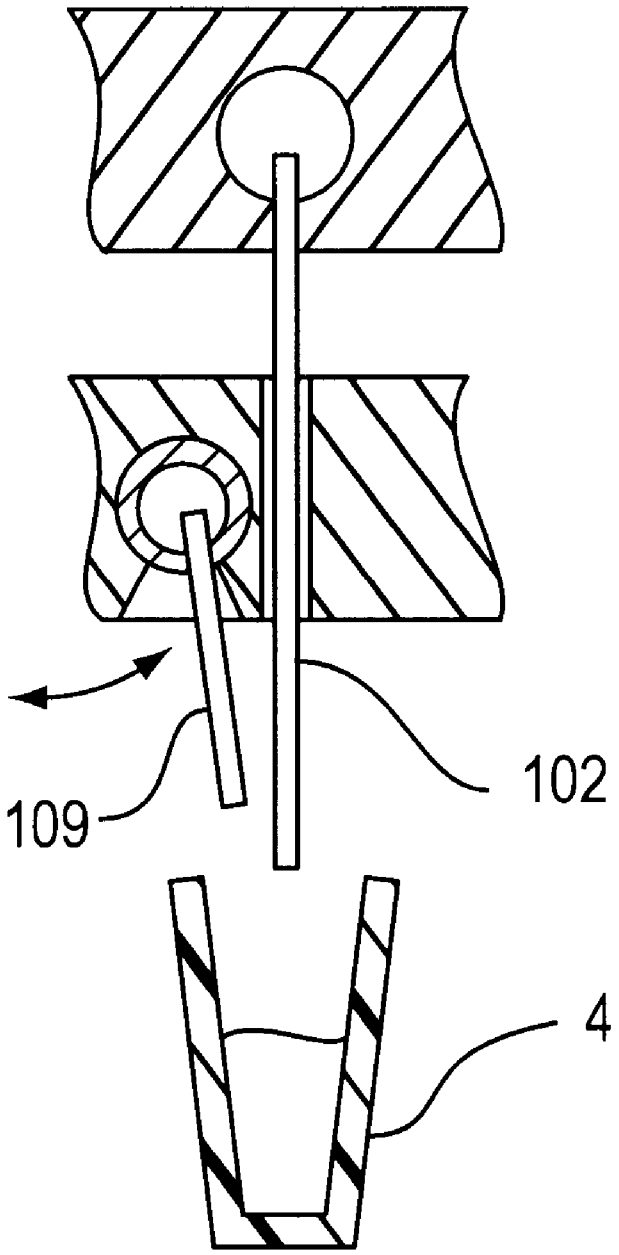
FIG. 12B is a cross-sectional view of dispense and aspirate pipes wherein the dispense pipe is rotatably coupled to the manifold.

In an embodiment as shown in FIGS. 11–12A, in order for the dispense pipe to be able to dispense a wash solution into a small well 4 associated with the newer well plates while the aspirate pipe 102 evacuates fluid from the same well as in the case of an overflow wash operation, a dispense pipe 109 can be used which is tilted from vertical so that the wash solution is jettisoned out at an angle and enters the well while the aspirate pipe 102 is positioned to aspirate the excess wash solution. The tilted dispense pipe 109 also results in a desirable swirling motion of the wash solution that enters the well and thus assures more vigorous washing if required. The titled dispense pipe can be either fixed to the manifold at a permanent angle, or as illustrated in FIG. 12B, can be rotatably coupled to the manifold.

Figure 12C:
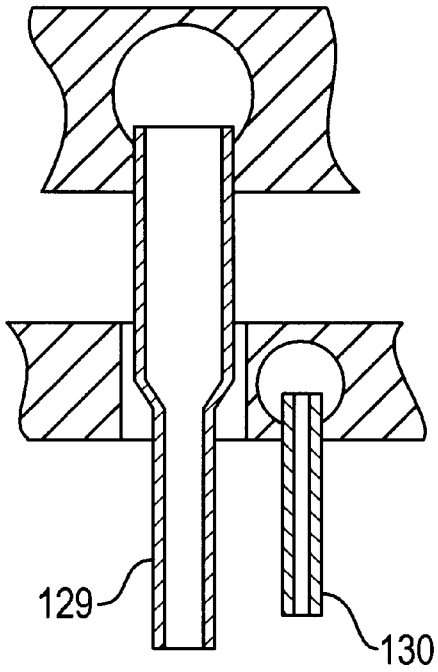
FIG. 12C is a cross-sectional view of dispense and aspirate pipes illustrating a narrow distal end of a pipe.
Figure 12D:
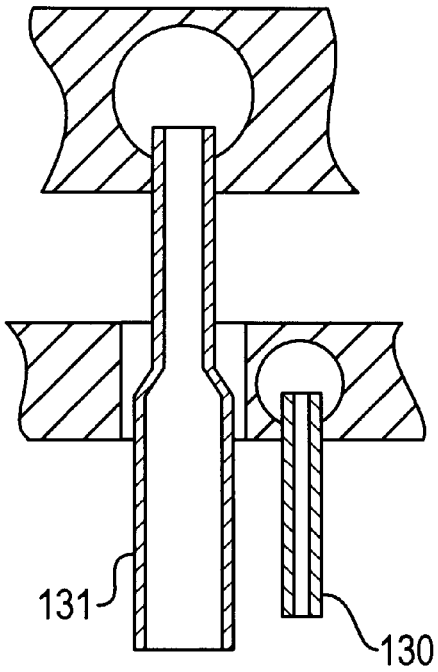
FIG. 12D is a cross-sectional view of dispense and aspirate pipes illustrating a large distal end of a pipe.

The ability to move or index the well plate 108 relative to the manifolds in the horizontal plane allows the aspirate pipes to be positioned close to the rim and thus permits the wash solution from the dispense pipes to enter the well. As shown in FIG. 12A, during the evacuation cycle the aspirate pipe 102 can be centered in the small well 4, and allowed to enter the well and evacuate it without touching the walls. Furthermore, as shown in FIG. 12C, the aspirate pipe 129 can be narrowed so as to have a reduced diameter at its lower end over a length slightly longer than the depth of the well. This would assure that the aspirate pipe fits into the smallest well possible. Similarly, the dispense pipe 130 can be narrowed so as to have a reduced diameter at its lower end over a length slightly longer than the depth of the well in order to permit its entry into the smaller wells. Alternatively, as shown in FIG. 12D, the aspirate pipe 131 can be made to have an enlarged diameter at its distal end so that the wash solution may be gently aspirated into the pipes.

Figure 13:
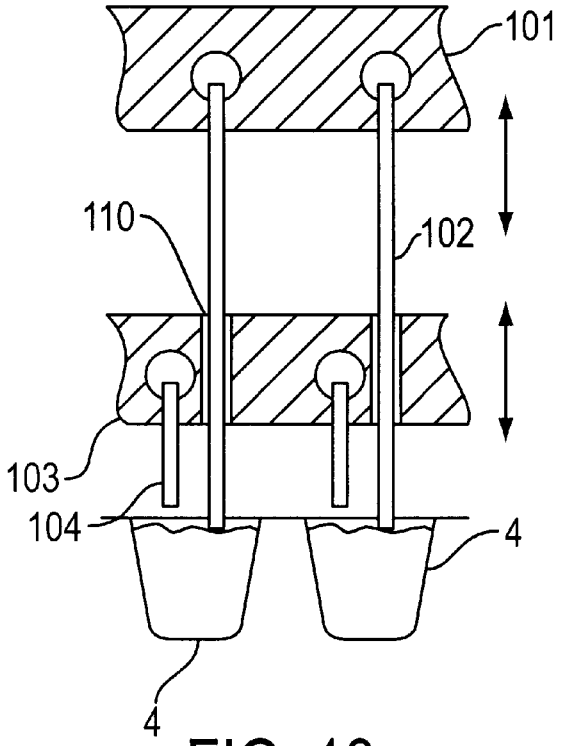
FIG. 13. is a cross-sectional view of dispense and aspirate pipes illustrating a dispense with overflow wash operation using straight pipes in accordance with an embodiment of the invention.
Figure 14:
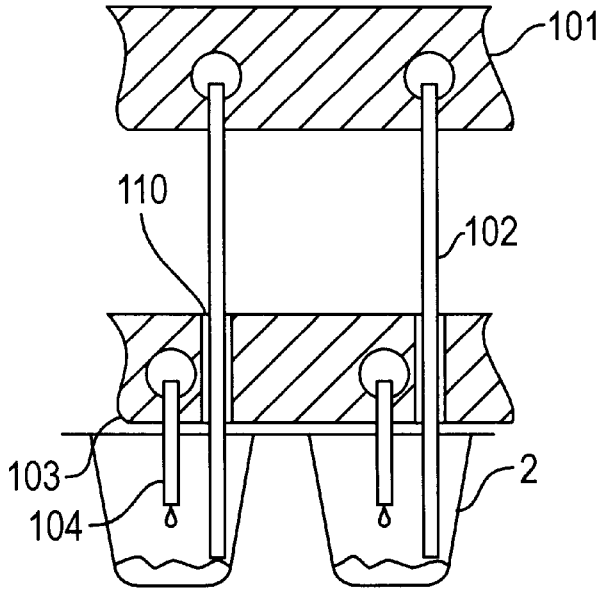
FIG. 14. is a cross-sectional view of dispense and aspirate pipes illustrating a bottom wash operation with straight pipes in accordance with an embodiment of the invention.

As described above, the aspirate and dispense manifolds are independently movable with respect to each other in the vertical direction. Thus, as shown in FIG. 13, both aspirate pipes 102 and dispense pipes 104 can be positioned at the rim of the well for performing an overflow wash operation. Alternatively, as shown in FIG. 14, both aspirate pipes 102 and dispense pipes 104 can be lowered into a well 2 having a larger diameter such as a well of the 96-well plate for effectively carrying out a bottom wash operation.

Figure 17:
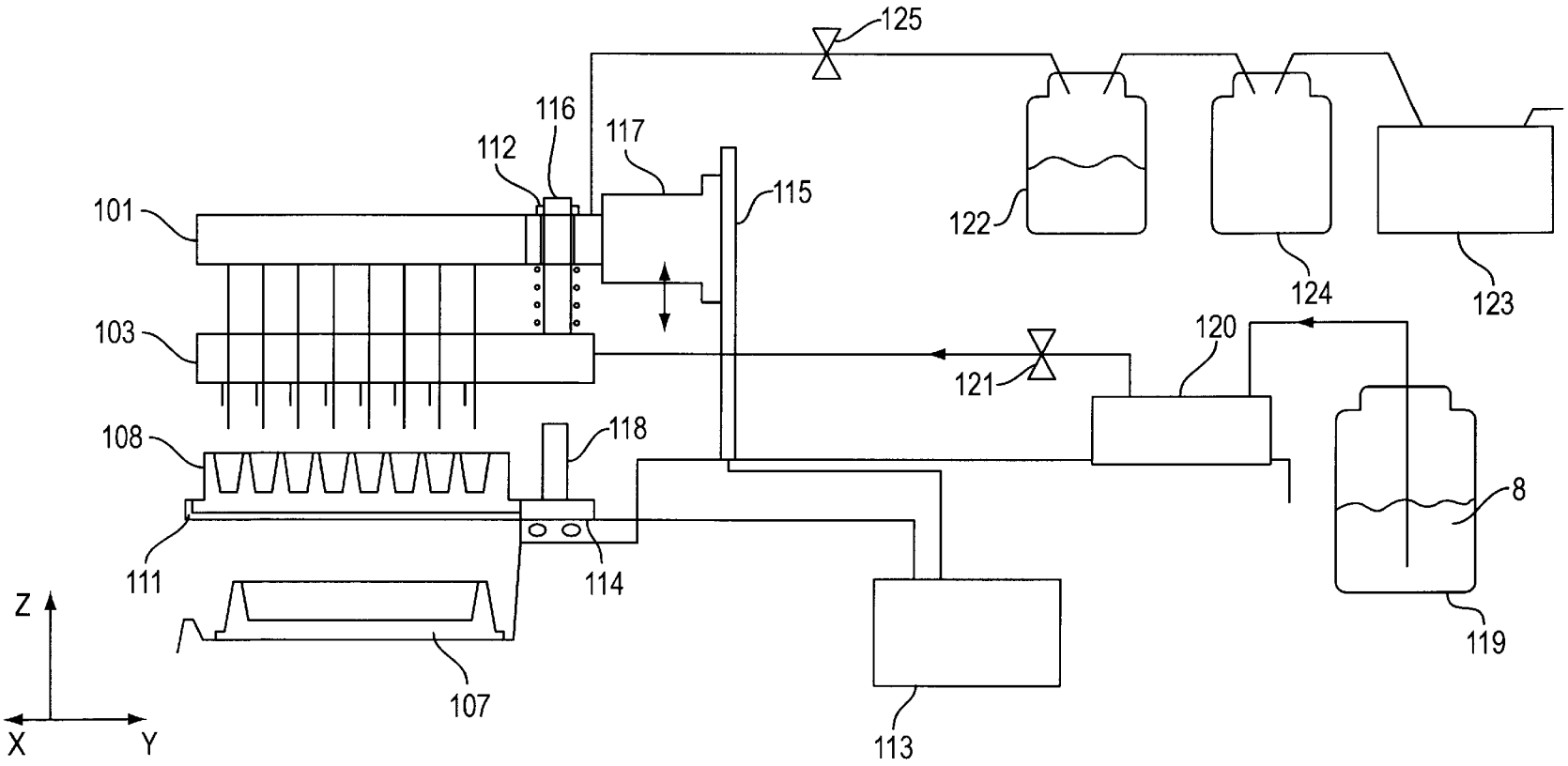
FIG. 17 is a schematic view of a washing apparatus of a preferred embodiment of the invention.

In another embodiment, the movement of one manifold can be slaved to that of the other manifold. For example, as shown in FIG. 17, the dispense manifold 103 can be slaved to the movement of the aspirate manifold 101 so that the dispense manifold stops automatically by a mechanical stop 118 during its downward movement so that only the aspirate pipes 102 enter the wells.

Figure 15B:
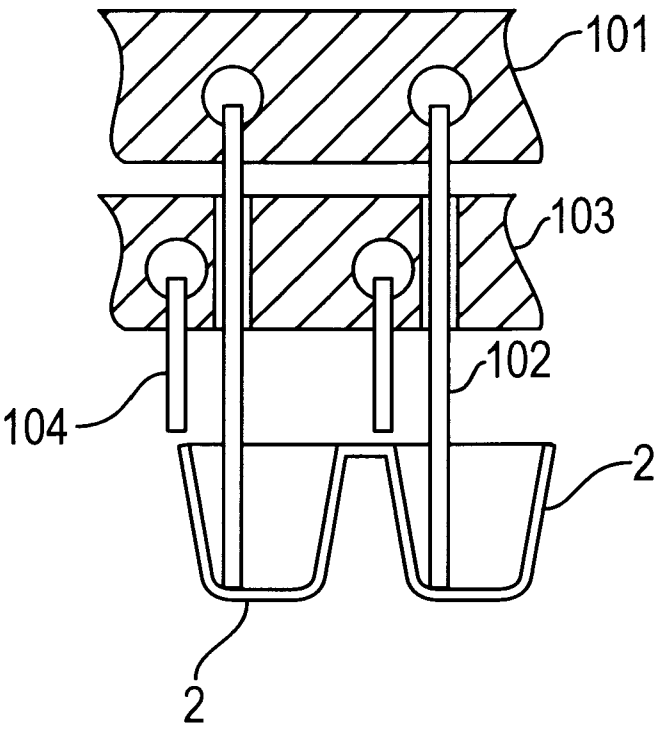
FIG. 15 is a cross-sectional view of dispense and aspirate pipes illustrating a "bottom sweep" evacuation wash operation of larger wells in accordance with an embodiment of the invention.
Figure 15A:
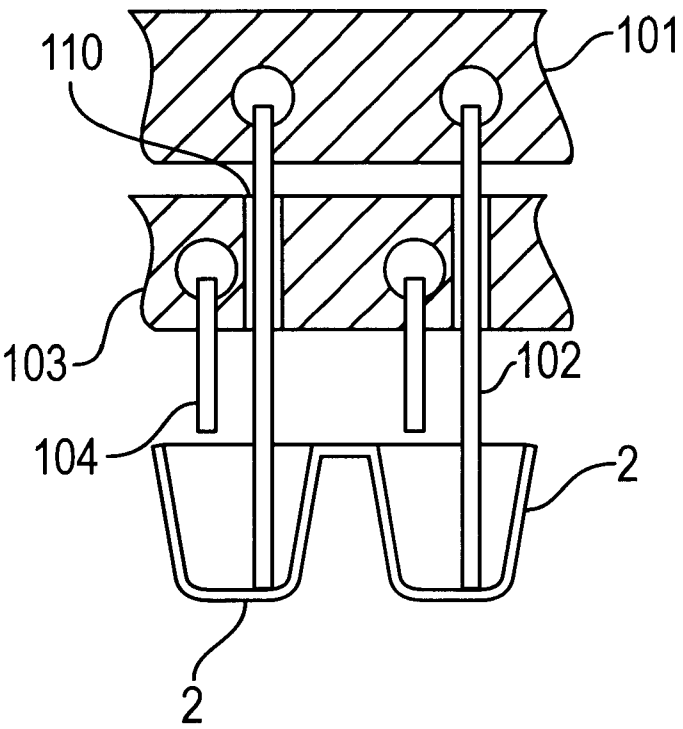

The relative horizontal movement of the manifolds and well plate that is required to wash plates of different well plate designs using the same set of manifolds can also be used to advantageously position the aspirate pipes in the well. For example, as shown in FIG. 15, the wells can be evacuated by sequentially moving the aspirate pipes 102 to several positions within the respective wells 2, or complex relative motions can be performed such as circumferential sweep of the bottom of the well to achieve a "bottom sweep" wash operation.

Figure 16:
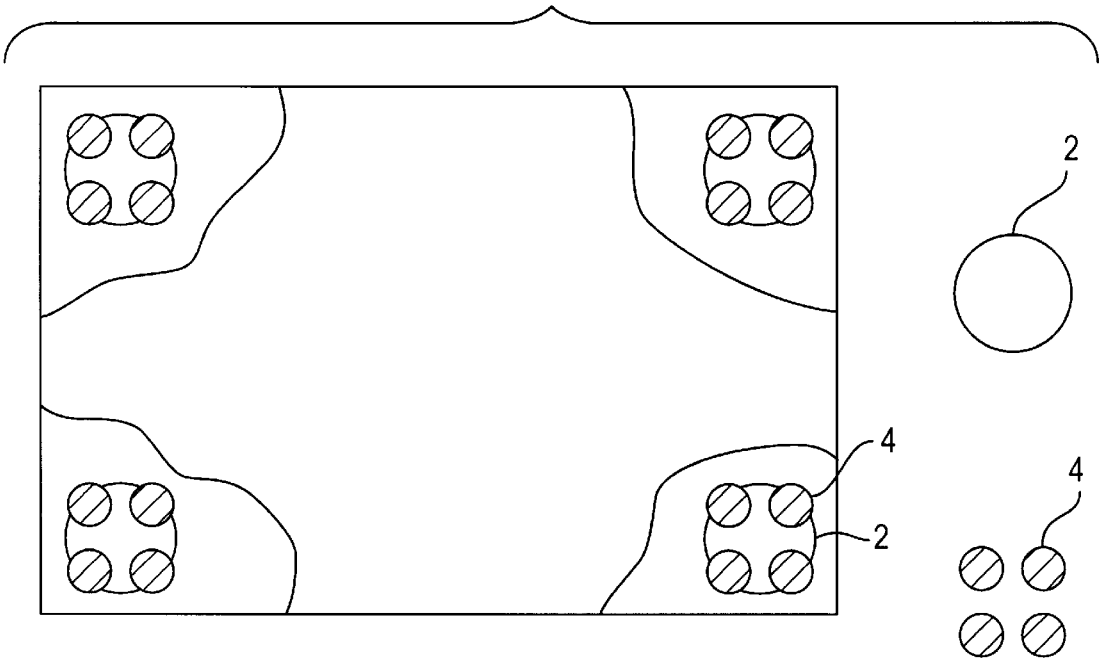
FIG. 16. is a top view of a well plate outline illustrating the relationship between an 8×12 and a 16×24 matrix well plates which allows using an 8×12 pipe configuration to wash 16×24 well plates.

In another embodiment of the invention, as shown in FIG. 16, the aspirate and dispense pipes can be arranged in a horizontal plane corresponding to an 8×12 well matrix having wells 2 spaced approximately 9 mm between centers (i.e., the matrix of a conventional 96-well plate). This arrangement of pipes can also be used for washing 384-well plates that have a 16×24 matrix with wells 4 spaced approximately 4.5 mm between centers by indexing the well plate relative to the manifold in the horizontal plane in an X-Y pattern 4 times to wash all the wells. Similarly, the arrangement can also be used for washing 1536-well plates that have a 32×48 matrix with wells spaced approximately 2.25 mm between center by indexing the well plate relative to manifold in the horizontal plane in an X-Y pattern 8 times to wash all the wells.

Alternatively, if a higher speed for washing a well plate is desired, a different piping matrix can be constructed having dispense and aspirate pipes spaced approximately 4.5 mm between centers in a direction of a column of wells and 9.0 mm between centers in a direction of a row of wells so that one pipe of each manifold fits into each well of in a column of the 384-well plate and 2 pipes of each manifold fit simultaneously into each well of the 96-well plate. Accordingly, only one indexing operation will be required to wash all 384 wells of a 384-well plate. Of course, other pipe matrix configurations may be used, the only limitation being the cost and practicality of increasing the number of pipes per manifold.

The above embodiment directed to moving the manifolds in the vertical and horizontal direction relative to a well plate can also be used with the priming trough 107 positioned below the well plate support 111 as shown in FIGS. 10 and 17. With the well plate support out of the way (i.e., when a wash operation is not being conducted) as shown in FIG. 10F, the dispense and aspirate manifolds can be automatically lowered so that end portions of the dispense and aspirate pipes are positioned in the trough for priming. This eliminates the need for the user to place a separate priming plate into the washing apparatus in the position of the well plate. The priming trough in accordance with the present invention can also be used to permit automatic periodic re-priming of the washer to prevent the pipes from drying out and to prevent salt crystallization inside the pipes.

It should be noted that the vertical movements of the manifolds described above is not limited to movement along a path perpendicular to the horizontal plane of the well plate or well plate support. Some well plates are made by injection molding wherein the inner walls of the wells are tilted from vertical by the mold draft angle. It may be advantageous, therefore, to lower the pipes into the well along the same or similar angle. The movement along a path slightly deviated from vertical is permissible and can be achieved by any known method since the method of implementation is not critical to the present invention.

Figure 18:
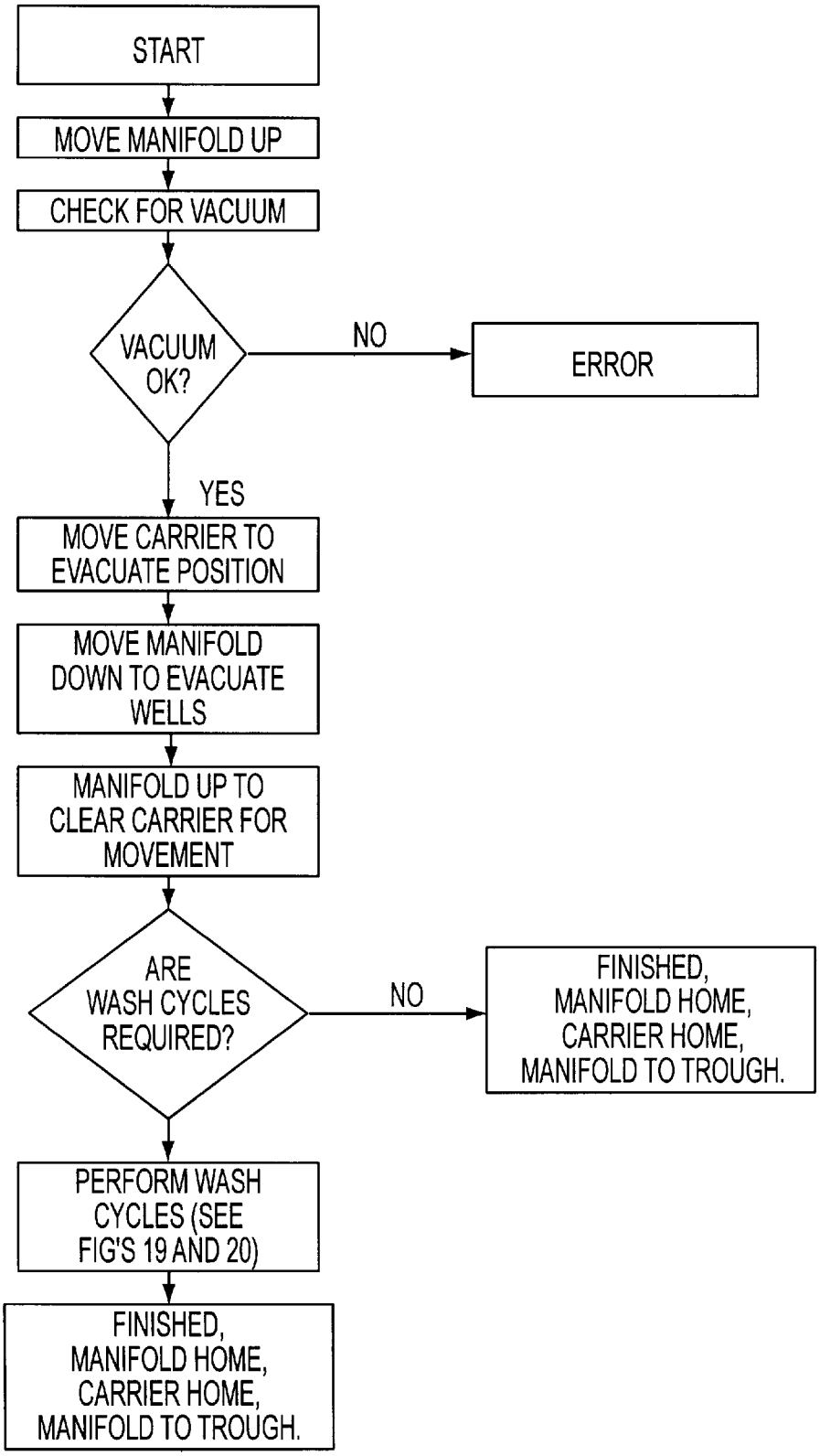
FIGS. 18–20 are flow charts showing an operation of the washer.
Figure 19:
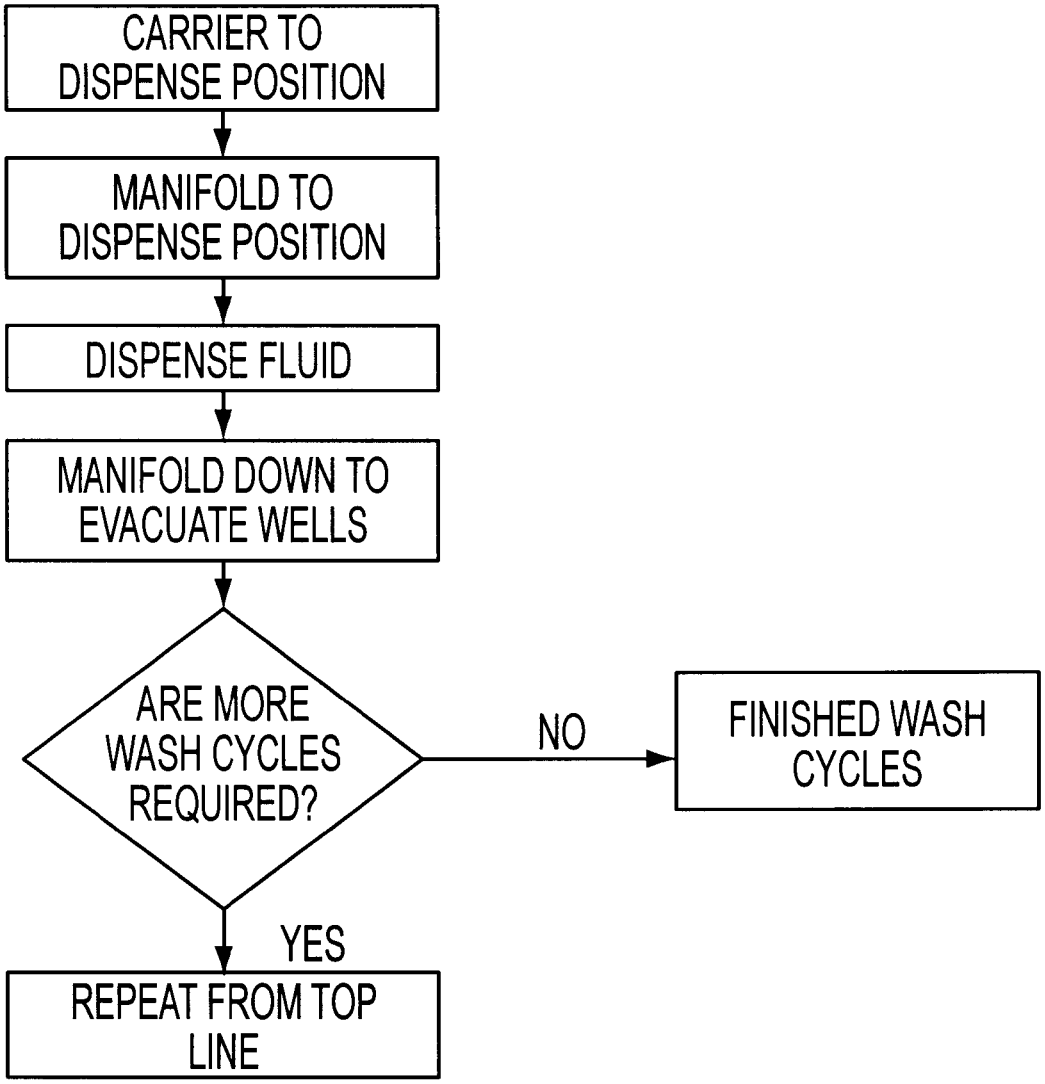
Figure 20:
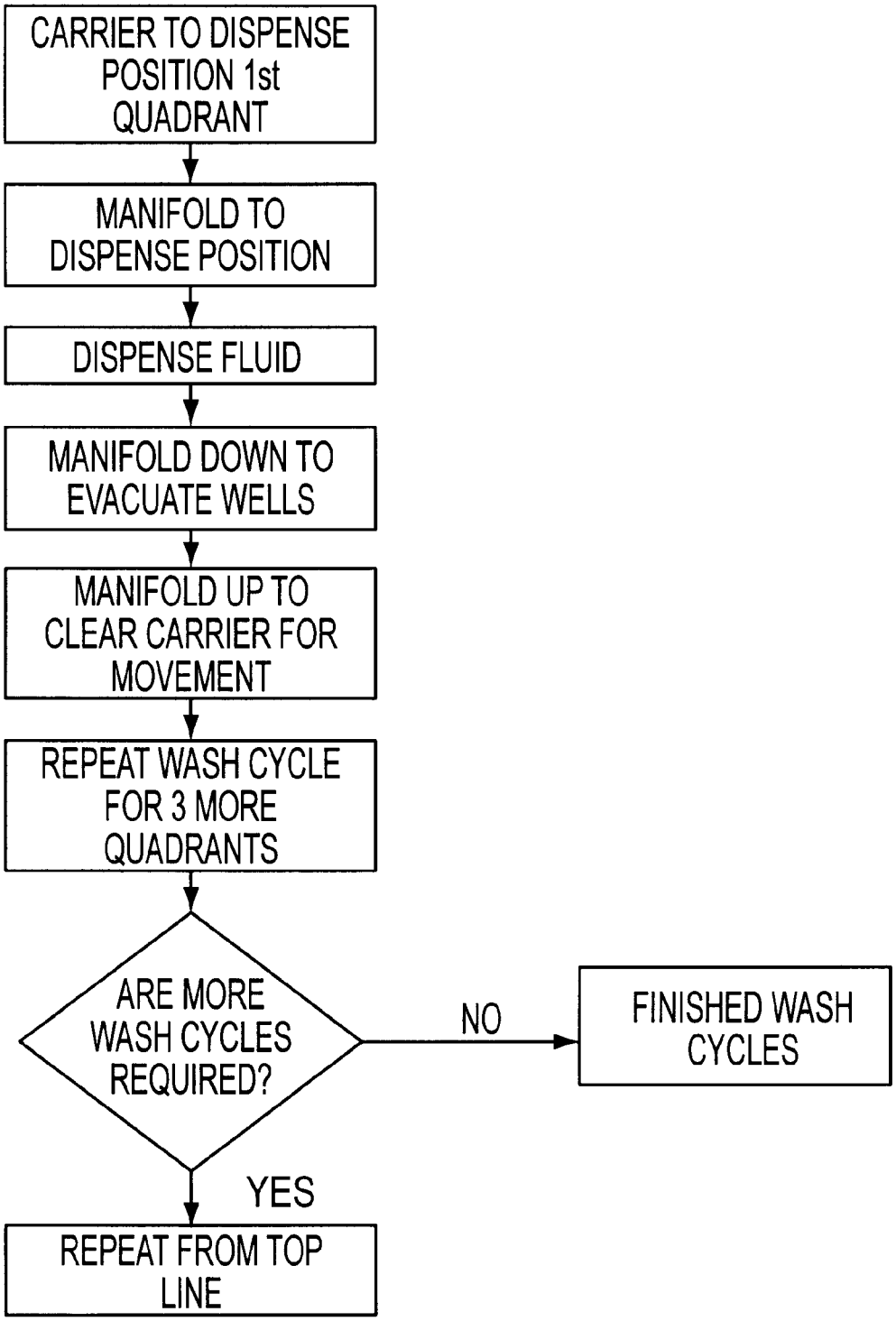

FIG. 17 provides a schematic of a complete washing apparatus built on the basis of the split top/bottom dispense and aspirate manifolds. FIGS. 18–20 provide a flow chart illustrating an example of the a control operation for the washer.

The well plate 108 is positioned on the well plate support mechanism or carrier 111 which in turn is moved into the washing position by the support mechanism positioning system 114 connected to the control unit 113. The support mechanism positioning system is also used to index the support plate in the horizontal X-Y plane relative to the manifolds during a washing operation as required. Alternatively, a drive mechanism for moving the top manifold 101 and bottom manifold 103 in the X-Y plane can be used to achieve the desired relative motion during a wash operation.

The illustrated embodiment shows the bottom manifold 103 as the dispense manifold which is slaved to the top aspirate manifold 101. The aspirate manifold 101 is lowered and raised along the linear guide way 115 along the z-axis by the driving mechanism 117 connected to the control mechanism 113. The dispense manifold 103 is suspended from the aspirate manifold 101 by a linear guide 116 and stopped from descending beyond a predetermined position relative to top manifold by a first stop 112. Furthermore, a second stop 118 is provided on the support mechanism 111 for preventing the dispense manifold 103 from entering into the small wells during a wash operation as the aspirate manifold 101 is lowered to evacuate the wells. Alternatively, second mechanical stops 132 can be formed on the bottom manifold as shown in FIG. 10B.

When the washing apparatus is idle (i.e., when a wash operation is not being performed), the support mechanism 111 and second stop 118 are moved out of the way and placed in a home position. The control unit 113 can then lower the top manifold and bottom manifold allowing their respective pipes to be lowered into the priming trough 107 so that the pipes may be primed or maintained in a liquid solution to prevent the formation of salt crystallization and the like.

The wash solution 8 is delivered into the dispense manifold from the source container 119 by means of a pump 120 and a valve 121. The wash solution is removed from the aspirate manifold 101 into a waste container 122 which is separated from a vacuum pump 123 by a trap 124. Opening valve 125 connects the aspirate manifold 101 to the waste container. It should be understood that any commonly known control mechanism can be used for controlling the dispensing of the wash solution independently from the evacuation of the wells. Furthermore, it is understood that any common method for delivering fluid to the dispense pipes and for evacuating fluid through the aspirate pipes can be used.

Therefore, the washing apparatus in accordance with the invention having separate dispense and aspirate manifolds which are independently movable along a vertical access and which are positioned one on top of the other is capable of performing wash operations on wells in a standard 96-well plate as well as those of the newer 384-well plate and 1536-well plate. Additionally, the washing apparatus in accordance with the invention is capable of performing a variety of wash operations such as a dispense with overflow wash operation and a bottom sweep wash operation.

Next, with reference to FIGS. 18–20, the operation of a washing process will be explained using a washing apparatus having only the top manifold (e.g., aspirate manifold) driven in the vertical direction while the bottom manifold (e.g., dispense manifold) is slidably supported to the top manifold so that when the top manifold descends, the bottom manifold will descend until mechanical stops mounted to the bottom manifold prevent further movement of only the bottom manifold.

Referring to FIG. 18, the operation begins with the manifold in the upward position. Prior to evacuation of the wells, the vacuum is checked. Next, the top manifold is driven downward towards the well plate to evacuate the wells, after which the top manifold is raised to clear the carrier for movement. In the case when wash cycles are required to be performed for a 96-well plate, for example as shown in FIG. 19, the carrier is positioned below the manifolds and the top manifold is moved downward so as to bring the bottom manifold to a dispense position for dispensing fluid. Next, the top manifold can be further lowered to evacuate the wells while the bottom manifold remains in position by the mechanical stop. This cycle can be repeated if necessary.

FIG. 20 illustrates the case in which a 384-well plate is washed. In this case, the well-plate is washed in 4 quadrants. The carrier is initially positioned in the first quadrant and the dispense and aspirate steps are carried out as in the 96-well plate. Next, the cycle is repeated three times to complete a washing operation for all the wells by repositioning the carrier in each quadrant prior to performing the subsequent dispense and aspirate operations.

While the foregoing embodiments describe the invention as having independently movable top and bottom manifolds, it is understood that a washing apparatus in accordance with the present invention can include a single manifold body connected to dispense and aspirate pipes such that the dispense and aspirate pipes are independently movable in the vertical direction with respect to one another. For example, a washing apparatus having a single manifold body design may include dispense and aspirate pipes separately arranged and supported by respective plates or other pipe support structures which are independently movable in the vertical direction, and wherein the dispense and aspirate pipes are connected to the manifold body by flexible tubes.

Furthermore, while the foregoing embodiments described the invention as having a support mechanism which is capable of indexing the well plate in the X-Y plane, an alternative is to allow the manifolds themselves to be indexed in the X-Y plane to achieve the same results.

It is also understood that an important aspect of the present invention is to have the dispense and aspirate pipes arranged on top of one another so that the manifolds can be independently moved relative to the support mechanism for the well plate. Although this can be achieved by independently moving the dispense and aspirate manifolds along a vertical guide, an alternative possibility is to have only one of the manifolds movable along a vertical guide and to have the support mechanism for the well plate also movable along a vertical path, thereby achieving the desired relative movement.

What is claimed is:

1. An apparatus for simultaneously washing a plurality of wells in a well plate, comprising:

a well plate support for supporting a well plate during a wash operation, a plurality of dispense pipes for dispensing a wash solution into the wells, a dispense pipe support structure for supporting said dispense pipes, a plurality of aspirate pipes for evacuating the wash solution from the wells, an aspirate pipe support structure for supporting said aspirate pipes, and a guide mechanism for changing relative horizontal and vertical distances between said dispense pipes and said aspirate pipes and between said dispense pipes and said well plate support;

said guide mechanism for changing relative horizontal and vertical distances further being operable, during the wash operation, for simultaneously positioning said dispense pipe support structure and said aspirate pipe support structure over the well plate support so that one of said dispense pipe support structure and said aspirate pipe support structure, defining a top pipe support structure, is positioned on top of the other of said dispense pipe support structure and said aspirate pipe support structure, defining a bottom pipe support structure.

2. An apparatus for simultaneously washing a plurality of wells in a well plate as in claim 1, wherein said guide mechanism for changing relative horizontal and vertical distances includes:

a first guide mechanism operable for raising and lowering said dispense pipe support structure relative to said well plate support during the wash operation, and a second guide mechanism operable for raising and lowering said aspirate pipe support structure relative to said well plate support independent of said first guide mechanism during the wash operation.

3. An apparatus for simultaneously washing a plurality of wells in a well plate as in claim 1, wherein said dispense pipes enter the same respective wells as said aspirate pipes when said dispense pipes and said aspirate pipes are lowered towards the well plate.

4. An apparatus for simultaneously washing a plurality of wells in a well plate, comprising:

a well plate support for supporting a well plate during a wash operation, a dispense manifold, a fluid delivery system connected to said dispense manifold, said fluid delivery system delivering a wash solution to said dispense manifold, an aspirate manifold connected to a fluid evacuation system, a plurality of dispense pipes connected to said dispense manifold for dispensing the wash solution into the wells, a plurality of aspirate pipes connected to said aspirate manifold for evacuating the wash solution from the wells, and a guide mechanism for changing relative horizontal and vertical distances between said dispense manifold and said aspirate manifold and between said dispense manifold and said well plate support;

wherein, during the wash operation, said dispense manifold and said aspirate manifold are simultaneously positioned over the well plate support so that one of said dispense manifold and said aspirate manifold, defining a top manifold, is positioned on top of the other of said dispense manifold and said aspirate manifold, defining a bottom manifold.

5. An apparatus for simultaneously washing a plurality of wells in a well plate as in claim 4, wherein said guide mechanism for changing relative horizontal and vertical distances includes:

a first guide mechanism for raising and lowering said dispense manifold relative to said well plate support, and a second guide mechanism for raising and lowering said aspirate manifold relative to said well plate support independent of said first guide mechanism.

6. An apparatus for simultaneously washing a plurality of wells in a well plate as in claim 5, where in said first guide mechanism comprises a first vertical guide and a first coupling member for coupling said top manifold to said first vertical guide, and wherein said second guide mechanism comprises a second vertical guide and a second coupling member for coupling said bottom manifold to said second vertical, said second vertical guide being supported by said top manifold.

7. An apparatus for simultaneously washing a plurality of wells in a well plate as in claim 4, wherein said dispense manifold is the top manifold and said aspirate manifold is the bottom manifold.

8. An apparatus for simultaneously washing a plurality of wells in a well plate as in claim 4, wherein said aspirate manifold is the top manifold and said dispense manifold is the bottom manifold.

9. An apparatus for simultaneously washing a plurality of wells in a well plate as in claim 4, wherein said bottom manifold has openings through which pipes connected to said top manifold pass when said top manifold is lowered towards said bottom manifold.

10. An apparatus for simultaneously washing a plurality of wells in a well plate as in claim 9, wherein said pipes connected to said top manifold and passing through said bottom manifold enter the same respective wells as pipes connected to said bottom manifold when said top manifold and bottom manifold are lowered towards the well plate.

11. An apparatus for simultaneously washing a plurality of wells in a well plate as in claims 10, wherein end portions of at least one of said dispense pipes and said aspirate pipes entering the wells has a reduced diameter.

12. An apparatus for simultaneously washing a plurality of wells in a well plate as in claim 4, further comprising a control unit for independently controlling the dispensing of the wash solution from the evacuation of the wash solution from the wells.

13. An apparatus for simultaneously washing a plurality of wells in a well plate as in claim 4, wherein the raising and lowering of said bottom manifold is slaved to the raising and lowering of said top manifold so that during a lowering of said top and bottom manifolds, said bottom manifold stops at a predetermined height set by a stop device while said top manifold continues to descend.

14. An apparatus for simultaneously washing a plurality of wells in a well plate as in claim 4, wherein said dispense pipes are disposed at an angle from vertical so that the wash solution dispensed from said dispense pipes enters respective wells of the well plate while said aspirate pipes simultaneously enter the respective wells of the well plate so as to perform a continuous overflow wash operation.

15. An apparatus for simultaneously washing a plurality of wells in a well plate as in claim 14, wherein said dispense pipes are disposed at an angle from vertical so that the wash solution dispensed from said dispense pipes is jettisoned so as to hit side walls of the respective wells of the well plate.

16. An apparatus for simultaneously washing a plurality of wells in a well plate as in claim 4, wherein said dispense pipes are disposed at an angle from vertical so that the wash solution dispensed from said dispense pipes enters respective wells of the well plate while creating a swirling fluid motion.

17. An apparatus for simultaneously washing a plurality of wells in a well plate as in claim 4, wherein end portions of said aspirate pipes have an enlarged diameter, thereby permitting a gentle aspiration operation.

18. An apparatus for simultaneously washing a plurality of wells in a well plate as in claim 4, further comprising an indexing mechanism for indexing said dispense and aspirate pipes in a horizontal plane so that said apparatus is operable for washing well plates having different configurations.

19. An apparatus for simultaneously washing a plurality of wells in a well plate as in claim 18, comprising 96 dispense pipes and 96 aspirate pipes configured for a 96-well plate, and wherein said indexing mechanism for indexing said dispense and aspirate pipes in a horizontal plane indexes said dispense pipes and said aspirate pipes four times to perform a wash operation on a 384-well plate and 8 times to perform a wash operation on a 1536-well plate.

20. An apparatus for simultaneously washing a plurality of wells in a well plate as in claim 4, further comprising an indexing mechanism for indexing said well plate support in a horizontal plane so that said apparatus is operable for washing well plates having different configurations.

21. An apparatus for simultaneously washing a plurality of wells in a well plate as in claim 20, wherein said indexing mechanism for indexing said well plate support in a horizontal plane indexes said well plate support four times to perform a wash operation on a 384-well plate and 8 times to perform a wash operation on a 1536-well plate.

22. An apparatus for simultaneously washing a plurality of wells in a well plate as in claim 4, further comprising a priming trough into which said dispense pipes and said aspirate pipes may be lowered.

23. An apparatus for simultaneously washing a plurality of wells in a well plate as in claim 4, wherein said dispense pipes are rotatably supported on said dispense manifold.

24. A method of simultaneously washing a plurality of wells in a well plate using a washing apparatus including a well plate support for supporting a well plate during a wash operation, a plurality of dispense pipes for dispensing a wash solution into the wells, a dispense pipe support structure for supporting said dispense pipes, a plurality of aspirate pipes for evacuating the wash solution from the wells, and an aspirate pipe support structure for supporting said aspirate pipes, comprising the steps of:

simultaneously positioning said dispense pipe support structure and said aspirate pipe support structure over the well plate support so that one of said dispense pipe support structure and said aspirate pipe support structure, defining a top pipe support structure, is positioned on top of the other of said dispense pipe support structure and said aspirate pipe support structure, defining a bottom pipe support structure; and moving at least two of said top pipe support structure, bottom pipe structure, and well plate support so as to bring said dispense pipes near the wells for dispensing the wash solution into respective wells of the well plate, and so as to bring said aspirate pipes respectively into the wells for evacuating the wash solution from the respective wells of the well plate.

25. A method of simultaneously washing a plurality of wells in a well plate in accordance with claim 24, wherein said step of moving at least two of said top pipe support structure, bottom pipe structure, and well plate support, further includes passing said pipes supported by said top pipe support structure through said bottom pipe support structure.

26. A method of simultaneously washing a plurality of wells in a well plate in accordance with claim 24, further comprising the step of raising and lowering said top pipe support structure and said bottom pipe support structure, and wherein said bottom pipe support structure stops at a predetermined height set by a stop device during the lowering of said top pipe support structure and said bottom pipe support structure while said top pipe support structure continues to descend.

27. A method of simultaneously washing a plurality of wells in a well plate in accordance with claim 24, further comprising the step of dispensing the wash solution from said dispense pipes so that the wash solution hits respective side walls of the well plates at an angle.

28. A method of simultaneously washing a plurality of wells in a well plate in accordance with claim 24, further comprising the steps of indexing in a horizontal plane said dispense pipe support structure and said aspirate pipe structure at least once so as to perform a wash operation on a well plate having a number of wells greater than a number of dispense pipes of the washing apparatus.

29. A method of simultaneously washing a plurality of wells in a well plate in accordance with claim 24, further comprising the steps of indexing in a horizontal plane said well plate support at least once so as to perform a wash operation on a well plate have a number of wells greater than a number of dispense pipes of the washing apparatus.

30. A method of simultaneously washing a plurality of wells in a well plate in accordance with claim 24, further comprising the steps of lowering said dispense pipes and said aspirate pipes into a priming trough.

* * * * *